US006531438B1

(12) United States Patent
Littig et al.

(10) Patent No.: US 6,531,438 B1
(45) **Date of Patent: *Mar. 11, 2003**

(54) RINSE-ADDED FABRIC CARE COMPOSITIONS COMPRISING LOW MOLECULAR WEIGHT LINEAR AND CYCLIC POLYAMINES

(75) Inventors: Janet Sue Littig, Fairfield, OH (US); Dieter Boeckh, Limburgerhof (DE); Oliver Borzyk, Speyer (DE); Serge Gabriel Pierre Roger Cauwberghs, Nieuwkerken (BE); Michael Ehle, Ludwigshafen (DE); Neil James Gordon, Strombeek-Bever (BE); Frederick Anthony Hartman, Cincinnati, OH (US); Soren Hildebrandt, Speyer (DE); Jurgen Alfred Lux, Fischbach (DE); Rajan Keshav Panandiker, West Chester, OH (US); Mark Robert Sivik, Ft. Mitchell, KY (US); William Conrad Wertz, West Harrison, IN (US); Christian Leo Marie Vermote, Zwijnaarde (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/786,937

(22) PCT Filed: Sep. 9, 1999

(86) PCT No.: PCT/US99/20624

§ 371 (c)(1),
(2), (4) Date: Mar. 12, 2001

(87) PCT Pub. No.: WO00/15745

PCT Pub. Date: Mar. 23, 2000

Related U.S. Application Data

(60) Provisional application No. 60/100,441, filed on Sep. 15, 1998.

(51) Int. Cl.[7] ..... C11D 3/26; C11D 3/30; C11D 7/32

(52) U.S. Cl. ..... 510/322; 510/329; 510/330; 510/340; 510/499; 510/500; 510/503; 510/504

(58) Field of Search ..... 510/302, 303, 510/305, 308, 311, 312, 318, 322, 329, 330, 340, 499, 500, 503, 504; 8/111, 137

(56) References Cited

U.S. PATENT DOCUMENTS

| | | | | |
|---|---|---|---|---|
| 3,821,147 A | | 6/1974 | Dickson | |
| 5,968,893 A | * | 10/1999 | Manohar et al. | 510/475 |
| 6,087,316 A | * | 7/2000 | Watson et al. | 510/400 |
| 6,127,331 A | * | 10/2000 | Cleary et al. | 510/528 |

FOREIGN PATENT DOCUMENTS

| | | | |
|---|---|---|---|
| DE | 196 43 281 A1 | | 4/1998 |
| DE | 19643281 | * | 4/1998 |
| JP | 55 045859 A | | 3/1980 |
| WO | WO 97/42282 | * | 11/1997 |
| WO | WO 97/42290 | * | 11/1997 |
| WO | WO 98/12296 | * | 3/1998 |

* cited by examiner

*Primary Examiner*—Gregory DelCotto
(74) *Attorney, Agent, or Firm*—James F. McBride; Kim W. Zerby; Steven W. Miller

(57) ABSTRACT

The present invention relates to fabric care compositions which comprise low molecular weight linear or cyclic polyamines which provide the compositions with addition fabric enhancement benefits inter alia fabric softness, fabric integrity, fabric appearance, fabric lubricity.

34 Claims, No Drawings

RINSE-ADDED FABRIC CARE COMPOSITIONS COMPRISING LOW MOLECULAR WEIGHT LINEAR AND CYCLIC POLYAMINES

This Application claims priority to U.S. Provisional Application Serial No. 60/100,441 filed Sep. 15, 1998.

FIELD OF THE INVENTION

The present application relates to rinse-added fabric care compositions which comprise one or more low molecular weight polyamines which provide enhanced fabric appearance benefits The low molecular weight polyamines of the present invention which mitigate fabric damage and improve fabric appearance are preferably modified polypropyleneimines having four backbone amino units.

BACKGROUND OF THE INVENTION

Formulators of rinse-added fabric care compositions include various ingredients. inter alia cationic softening actives, anti-static agents, dye transfer inhibitors, and bleach-damage mitigating agents, for the purpose of improving fabric appearance, fabric feel, fabric color and to extend the duration of fabric life. Ingredients which are added to these compositions must not only provide a benefit, but must be compatible with a variety of product forms, i.e. liquid dispersions, isotropic liquids including clear, colorless/translucent liquids which may include principal solvents inter alia 1,2-hexanediol, 2,2,4-trimethyl-1,3-pentanediol (TMPD).

Many adjunct ingredients which provide fabric enhancement benefits are highly fabric substantive and, therefore, once deposited on the fabric surface remain with the fabric thereby providing the intended benefit until chemically altered or until displaced by a more fabric substantive material. High molecular weight modified polyalkyleneimines have been used in rinse-added fabric care compositions to mitigate fabric damage. These highly fabric substantive ingredients are deposited onto fabric during the near neutral pH environment of the laundry rinse cycle. Once deposited they serve a variety of purposes depending upon the absolute structure of the polyalkyleneamine or polyalkyleneimine and whether the polymeric amine is modified (for example, ethoxylated).

Color integrity is an important aspect of fabric enhancement. When certain polyamines are deposited onto fabric they enhance color fidelity via various mechanisms. Other polyamines intercept peroxygen bleaching agents at the fabric surface.

Consumers use bleach-containing compositions when washing colored fabric as well as white fabric because the use of a bleaching material satisfies the consumers need to feel that the fabric has been "thoroughly cleaned". Therefore, there is a long felt need to provide colored fabric with protection against the pejorative effects of laundry-added bleaching materials. In addition there is a need for materials which will be highly water soluble or water dispersible, while exhibiting a high degree of fabric substantivity. And there is also a need for a material which will provide a high level of fabric protection on an efficient per unit weight basis.

SUMMARY OF THE INVENTION

The present invention meets the aforementioned needs in that it has been surprisingly discovered that polyamines, preferably linear propyleneimines and 1,4-piperazines having at least one N-substituted 3-aminopropylene unit, and which have a backbone molecular weight, prior to any subsequent modification, of approximately 250 daltons, and which remain unmodified, or which are partially or fully modified, are suitable for use in rinse-added fabric care compositions to provide a wide array of fabric appearance benefits depending upon the type of substitution selected by the formulator inter alia mitigation of fabric damage via bleaching agents.

A first aspect of the present invention which relates to the issue of fabric color fidelity, are rinsed-added fabric enhancement compositions comprising:

a) from about 0.01%, preferably from about 0.75%, more preferably from 2%, to about 50%, preferably to about 35%, more preferably to about 20%, most preferably to about 15% by weight, of one or more modified polyamines, said polyamines selected from:

i) linear polyamines having the formula:

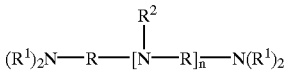

wherein each R is independently $C_2$–$C_6$ linear alkylene, $C_3$–$C_6$ branched alkylene, and mixtures thereof; $R^1$ is hydrogen, $C_1$–$C_{12}$ alkyl, alkyleneoxy having the formula:

$$—(R^3O)_m—R^4$$

$R^3$ is $C_2$–$C_6$ linear alkylene, $C_3$–$C_6$ branched alkylene, or mixtures thereof, $R^4$ is hydrogen, $C_1$–$C_6$ alkyl, or mixtures thereof, m is from 1 to 4; acyl having the formula:

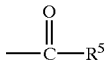

wherein $R^5$ is $C_1$–$C_{22}$ linear or branched alkyl, $C_3$–$C_{22}$ linear or branched alkenyl, or mixtures thereof; hydroxy alkyl having the formula:

$$—(CH_2)_y(CHOH)_zH$$

wherein y is from 1 to 5, z is from 1 to 3, provided y+z is less than or equal to 6; two $R^1$ units can be taken together to form a 5–7 member ring; and mixtures thereof; $R^2$ is hydrogen, $R^1$, $—RN(R^1)_2$, and mixtures thereof; n is from 1 to 6;

ii) cyclic polyamines having the formula:

$$R—L—R$$

wherein L is a linking unit, said linking unit comprising a ring having at least 2 nitrogen atoms; R is hydrogen, $—(CH_2)_kN(R^1)_2$, and mixtures thereof, wherein each $R^1$ is hydrogen; $C_1$–$C_{12}$ alkyl; alkyleneoxy having the formula:

$$—(R^3O)_m—R^4$$

$R^3$ is $C_2$–$C_6$ linear alkylene, $C_3$–$C_6$ branched alkylene, or mixtures thereof, $R^4$ is hydrogen, $C_1$–$C_6$ alkyl, or mixtures thereof, m is from 1 to 4; acyl having the formula:

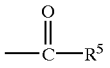

wherein $R^5$ is $C_1$–$C_{22}$ linear or branched alkyl, $C_3$–$C_{22}$ linear or branched alkenyl, or mixtures thereof; hydroxy alkyl having the formula:

$$—(CH_2)_y(CHOH)_zH$$

wherein y is from 1 to 5, z is from 1 to 3, provided y+z is less than or equal to 6; two $R^1$ units can be taken together to form a 5–7 member ring;

k is from 3 to 12; and mixtures thereof;

iii) and mixtures thereof;

b) optionally from about 1%, preferably from about 10%, more preferably from about 20% to about 80%, preferably to about 60%, more preferably to about 45% by weight, of a fabric softening active;

c) optionally less than about 15% by weight, of a principal solvent, preferably said principal solvent has a C log P of from about 0.15 to about 1;

d) optionally from about 0.001% to about 90% by weight, of one or more dye fixing agents;

e) optionally from about 0.01% to about 50% by weight, of one or more cellulose reactive dye fixing agents;

f) optionally from about 0.01% to about 15% by weight, of a chlorine scavenger;

g) optionally about 0.005% to about 1% by weight, of one or more crystal growth inhibitors;

h) optionally from about 0.01% to about 20% by weight, of a fabric abrasion reducing polymer;

i) optionally from about 1% to about 12% by weight, of one or more liquid carriers;

j) optionally from about 0.001% to about 1% by weight, of an enzyme;

k) optionally from about 0.01% to about 8% by weight, of a polyolefin emulsion or suspension;

l) optionally from about 0.01% to about 0.2% by weight, of a stabilizer;

m) optionally from about 1% to about 80% by weight, of a fabric softening active;

n) optionally from about 0.5% to about 10% by weight, of a cationic nitrogen compound; and o) the balance carrier and adjunct ingredients.

Another aspect of the present invention relates to clear, colorless or translucent isotropic liquids which are rinse-added fabric color fidelity enhanced compositions. These isotropic liquid embodiments typically comprise less than about 95%, preferably less than about 50%, more preferably less than about 25%, most preferably less than about 15% by weight of a principal solvent as defined herein below.

The present invention also relates to fabric enhancement compositions which comprise a fabric care composition which comprises both a linear polyamine and a cyclic polyamine.

A further aspect of the present invention relates to liquid dispersion forms of the rinse-added compositions which may comprise polyamines which provide, in addition to color fidelity benefits, metal chelation and chlorine scavenging properties which provide enhanced fabric softness, integrity, and appearance. These and other objects, features and advantages will become apparent to those of ordinary skill in the art from a reading of the following detailed description and the appended claims.

All percentages, ratios and proportions herein are by weight, unless otherwise specified. All temperatures are in degrees Celsius (°C.) unless otherwise specified. All documents cited are in relevant part, incorporated herein by reference.

DETAILED DESCRIPTION OF THE INVENTION

The present invention relates to rinse-added fabric care compositions. The compositions of the present invention provide increased color fidelity benefits to fabric in addition to other desirable benefits, inter alia fabric softness, fabric integrity, fabric appearance, fabric lubricity. The rinse-added fabric care compositions may take any form, for example, solids (i.e., powders, granules, extrudates), gels, thixotropic liquids, liquids (i.e., dispersions, isotropic solutions), preferably the rinse added fabric care compositions take the form of liquid dispersions or isotropic liquids.

It has now been surprisingly discovered that low molecular weight propyleneimines, preferably polypropyleneimines (backbones having a MW<250 daltons) or cyclic amines, preferably comprising a N,N'-bis-1,4-substituted piperazine ring, are highly fabric substantive and, in addition, are capable of intercepting bleaching agents which may approach the fabric surface. It has also been surprisingly discovered that a 3-carbon propylene spacing between nitrogen atoms of linear portions of the polyamine molecules provides for improved discrimination in the chelation of unwanted copper ions in solution over desirable copper which is included in the dye systems of fabric.

The compositions of the present invention comprise from about 0.01%, preferably from about 0.75%, more preferably from 2%, to about 50%, preferably to about 35%, more preferably to about 20%, most preferably to about 15% by weight, of the herein described polyamines.

The following describe in detail the essential elements of the present invention.

Linear Polyamines

The enhanced fabric appearance compositions of the present invention may comprise one or more polyalkyleneimines which have backbones comprising $C_2$–$C_6$ alkylene units, however, the backbones must comprise at least one $C_3$–$C_6$ alkylene unit, preferably the linear polyamines have each backbone unit comprising a $C_3$–$C_6$ alkylene unit.

The polyamines of the present invention have the formula:

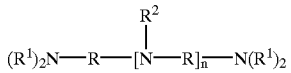

wherein each R is independently $C_2$–$C_6$ linear alkylene, $C_3$–$C_6$ branched alkylene, and mixtures thereof; preferably the backbone is a mixture of ethylene, 1,3-propylene, 1,3-propylene, 1,4-butylene, 1,6-hexylene, more preferably a mixture of ethylene and 1,3-propylene, most preferably the backbone comprises only 1,3-propylene units.

$R^1$ is hydrogen; $C_1$–$C_{12}$ alkyl, preferably $C_1$–$C_8$ alkyl, more preferably $C_1$–$C_4$ alkyl; alkyleneoxy having the formula:

$$—(R^3O)_m—R^4$$

wherein $R^3$ is $C_2$–$C_6$ linear alkylene, $C_3$–$C_6$ branched alkylene, or mixtures thereof; preferably ethylene, mixtures of ethylene and 1,2-propylene, 1,2-butylene, preferably ethylene, 1,2-propylene. $R^4$ is hydrogen, $C_{1-6}$ alkyl, or mixtures thereof; preferably hydrogen or methyl, more preferably hydrogen. The index m is from 1 to 4, however, the value of m is predicated on the desired fabric enhancement benefit sought by the formulator. For example, the level of bleach protection varies over the value of m. Also, the dye fixation properties of the substantially linear polyamines are maximized when the alkyleneoxy unit is absent, i.e., $R^1$ and $R^2$ are hydrogen. $R^1$ is also acyl having the formula:

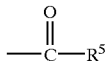

wherein $R^5$ is $C_1$–$C_{22}$ linear or branched alkyl, $C_3$–$C_{22}$ linear or branched alkenyl, or mixtures thereof; preferably $R^5$ is a hydrocarbyl moiety which sufficiently provides increased fabric lubricity, more preferably $C_6$–$C_{12}$ alkyl; hydroxy alkyl having the formula:

$$—(CH_2)_y(CHOH)_zH$$

wherein the index y is from 1 to 5, z is from 1 to 3, provided y+z is less than or equal to 6 and the —(CHOH)— unit is not directly attached to a nitrogen atom. Non-limiting examples of hydroxy alkyl units include 2-hydroxy alkyl, for example, $—CH_2CHOHCH_3$, $—CH_2CHOHCH_2CH_2CH_2CH_3$. Two $R^1$ units can be taken together to form a 5–7 member ring, i.e., piperidine, morpholine. An example of a backbone wherein two $R^1$ units are taken together to form a ring has the formula:

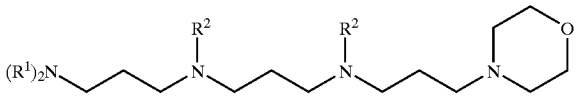

The present invention also includes mixtures of the herein described $R^1$ units.

$R^2$ is hydrogen, $R^1$, $—RN(R^1)_2$, and mixtures thereof. The integer n has the value from 1 or 6; preferably from 1 to 4, more preferably 1 or 3.

Most prefered linear polyamine has a backbone wherein R is 1,3-propylene and n is equal to 2, N,N'-bis(3-aminopropyl)-1,3-propylenediamine (TPTA). This preferred backbone can then be substituted or left unsubstituted in a manner which affords the formulator the maximal fabric benefit and compatibility of the low molecular weight amine with the particular embodiment. As a non-limiting example, when $R^1$ and $R^2$ are each equal to hydrogen, dye fixative properties, in certain liquid fabric care embodiments, even in the presence of bleach, are maximal. Also when $R^1$ and $R^2$ are not equal to hydrogen, bleach scavenging benefits are enhanced.

Those of ordinary skill in the art will recognize that depending upon the synthetic procedure used to prepare the polypropyleneamine backbones, varying amounts of both the linear and branched materials will be present in the final product admixture. The preferred backbones of the linear polyamines of the present invention comprise at least one 1,3-propylene unit, preferably at least two 1,3-propylene units.

For the purposes of the present invention, when a backbone nitrogen is referred to as "unmodified" the nitrogen contains only hydrogen atoms. "Modified" polyamines have one or more alkyleneoxy units as described herein above. Preferred substituents are methyl, 2-hydroxyethyl, 2-hydroxypropyl, 1,2-propyleneoxy, 2-hydroxybutyl, and mixtures thereof, more preferably methyl and 2-hydroxypropyl.

For certain formulations, polyamines which comprise alkylated polyamines are preferred, for example, tetramethyl dipropylenetriamine (5-N-methyl dipropylenetriamine) having the formula:

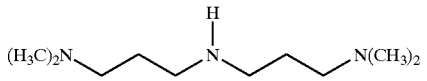

the permethylated dipropylenetriamine (1,1-N-dimethyl-5-N'-methyl-9,9-N"-dimethyl dipropylenetriamine) having the formula:

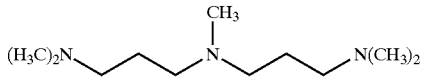

and the mono-methylated dipropylenetriamine (5-N-methyl dipropylenetriamine) having the formula:

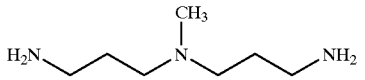

Cyclic Amines

The enhanced fabric appearance compositions of the present invention may comprise one or more cyclic polyalkyleneamines wherein at least one of the ring nitrogens is substituted with at least one $C_3$–$C_6$ alkyleneimine unit.

The low molecular weight cyclic polyamines of the present invention comprise polyamine backbones having the formula:

$$R—L—R$$

wherein L is a linking unit, said linking unit comprising a ring having at least 2 nitrogen atoms; for example, 1,4-piperazine. R is hydrogen, $—(CH_2)_kN(R^1)_2$, and mixtures thereof, wherein at least one cyclic polyamine R unit is a $—(CH_2)_kN(R^1)_2$ unit; preferably both R units are $—(CH_2)_kN(R^1)_2$; wherein each index k independently has the value from 3 to 12, preferably k is 3. Preferably the backbone of the cyclic amines including R units is 250 daltons or less. Most preferred backbone ring is 1,4-piperazine.

$R^1$ is hydrogen; $C_1$–$C_{12}$ alkyl, preferably $C_1$–$C_8$ alkyl, more preferably $C_1$–$C_4$ alkyl, most preferably methyl; alkyleneoxy having the formula:

$$—(R^3O)_m—R^4$$

wherein $R^3$ is $C_2$–$C_6$ linear alkylene, $C_3$–$C_6$ branched alkylene, or mixtures thereof; preferably ethylene, mixtures of ethylene and 1,2-propylene, 1,2-butylene, preferably ethylene, 1,2-propylene. $R^4$ is hydrogen, $C_1$–$C_6$ alkyl, or mixtures thereof; preferably hydrogen or methyl, more preferably hydrogen. The index m is from 1 to 4, however, the value of m is predicated on the desired fabric enhancement benefit sought by the formulator. For example, the level of bleach protection varies over the value of m. $R^1$ is also acyl having the formula:

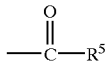

wherein $R^5$ is $C_1$–$C_{22}$ linear or branched alkyl, $C_3$–$C_{22}$ linear or branched alkenyl, or mixtures thereof; preferably $R^5$ is a hydrocarbyl moiety which sufficiently provides increased fabric lubricity, more preferably $C_6$–$C_{12}$ alkyl; hydroxy alkyl having the formula:

$$—(CH_2)_y(CHOH)_zH$$

wherein the index y is from 1 to 5, z is from 1 to 3, provided y+z is less than or equal to 6 and the —(CHOH)— unit is not directly attached to a nitrogen atom. Non-limiting examples of hydroxy alkyl units include 2-hydroxy alkyl, for example, $—CH_2CHOHCH_3$, $—CH_2CHOHCH_2CH_2CH_2CH_3$. Two $R^1$ units can be taken together to form a 5–7 member ring, i.e., pipendine, morpholine.

Preferably the backbone of the cyclic amines of the present invention comprise a N,N'-bis-substituted 1,4-piperazine ring having the formula:

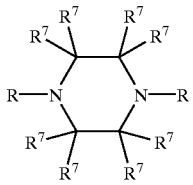

wherein each $R^7$ is independently hydrogen, $C_1$–$C_4$ alkyl, $C_1$–$C_4$ hydroxyalkyl, $C_1$–$C_4$ aminoalkyl, or two $R^7$ units of the same carbon atom are bonded to oxygen thus forming a carbonyl group (C═O) wherein the carbon atom is a ring atom, and mixture thereof Examples of carbonyl containing rings which comprise L units are 1,4-diketopiperizines. Preferably the backbones of the polyamines of the present invention, prior to modification, have the formula:

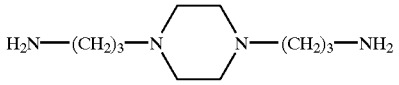

wherein each R unit is $—(CH_2)_3NH_2$.

However, the cyclic units may be substituted on only one ring nitrogen as in the case wherein one R unit is hydrogen, and the other R unit is $—(CH_2)_kNH_2$, for example, the piperazine having the formula:

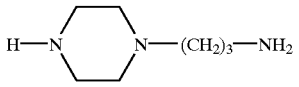

The backbones of the cyclic polyamines of the present invention preferably comprise at least one 1,3-propylene unit, more preferably at least two 1,3-propylene units.

For the purposes of the present invention, when a backbone nitrogen is referred to as "unmodified" the nitrogen contains only hydrogen atoms. "Modified" polyamines have one or more substituent units as described herein above. Preferably when the backbone units are modified all of the nitrogens are modified. Preferred alkyleneoxy substituents are ethyleneoxy, 1,2-propyleneoxy, and mixtures thereof, more preferably 1,2-propyleneoxy.

An example of a preferred polyamine according to the present invention is N,N'-bis(hydroxyethyl)-N,N'-bis[3-N,N-bis(hydroxyethyl)aminopropyl]-1,3-propylenediamine having the formula:

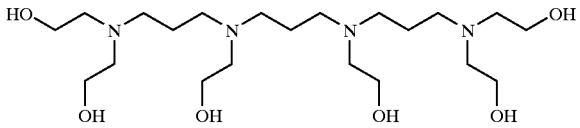

Effects of Backbone Modifications

The polyamines of the present invention provide a multiplicity of fabric care and fabric enhancement benefits. Chlorine scavenging benefits are achieved with all of the polyamines independent of the degree of branching (i.e. the number of primary, secondary, and tertiary nitrogens).

It has been surprisingly found that bleach protection is enhanced when the backbone nitrogens are substituted with one or more modifications which comprise an alkyleneoxy unit having the general formula:

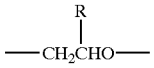

said unit is $R^3$ as defined herein above. However, if the formulator wishes to enhance the dye fixation properties of the presently disclosed polyamines, the backbone nitrogens will not be substituted with an alkyleneoxy unit.

The negative chelation effects, inter alia, extraction of heavy metal ions associated with fabric dyes, are overcome and optimal dye integrity is achieved when the polyamine backbone comprises $C_2$–$C_3$, preferably $C_3$ (1,3-propylene) units, and the backbone nitrogens are per-substituted, preferably by sterically hindered substituents. However, when the polyamine backbone, prior to nitrogen substitution comprises $C_2$ (ethylene) untis, for dye integrity benefits, the nitrogens must be "per-substituted". The term "per-substituted" is defined as "each hydrogen of the polyamine backbone is substituted". This choice of substituent being affected by the other properties which are desired and to the compatibility of the polyamine within the final formulation.

Adjunct Ingregients

The compositions of the present invention may also optionally comprise one or more adjunct ingredients. Non-limiting examples of adjunct ingredients are selected from the group consisting of electrolytes, stabilizers, low molecular weight water soluble solvents, chelating agents, cationic charge boosters, dispersibility aids, soil release agents, non-ionic fabric softening agents, concentration aid, perfume, preservatives, colorants, optical brighteners, opacifiers, fabric care agents, anti-shrinkage agents, anti-winkle agents, fabric crisping agents, spotting agents, germicides, fungicides, anti-corrosion agents, antifoam agents, and mixtures thereof.

Dye Fixing Agents

The compositions of the present invention optionally comprise from about 0.001%, preferably from about 0.5% to about 90%, preferably to about 50%, more preferably to about 10%, most preferably to about 5% by weight, of one or more dye fixing agents.

Dye fixing agents, or "fixatives", are well-known, commercially available materials which are designed to improve the appearance of dyed fabrics by minimizing the loss of dye from fabrics due to washing. Not included within this definition are components which can in some embodiments serve as fabric softener actives.

Many dye fixing agents are cationic, and are based on quaternized nitrogen compound or on nitrogen compounds having a strong cationic charge which is formed in situ under the conditions of usage. Cationic fixatives are available under various trade names from several suppliers. Representative examples include: CROSCOLOR PMF (July 1981, Code No. 7894) and CROSCOLOR NOFF (January 1988, Code No. 8544) ex Crosfield; INDOSOL E-50 (Feb. 27, 1984, Ref. No. 6008.35.84; polyethyleneamine-based) ex Sandoz; SANDOFIX TPS, ex Sandoz, is a preferred dye fixative for use herein. Additional non-limiting examples include SANDOFIX SWE (a cationic resinous compound) ex Sandoz, REWIN SRF, REWIN SRF-O and REWIN DWR ex CHT-Beitlich GMBH; Tinofix® ECO, Tinofix® FRD and Solfin® ex Ciba-Geigy.

Other cationic dye fixing agents are described in "After-treatments for Improving the Fastness of Dyes on Textile Fibres", Christopher C. Cook, *Rev. Prog. Coloration,* Vol. XII, (1982). Dye fixing agents suitable for use in the present invention are ammonium compounds such as fatty, acid-diamine condensates inter alia the hydrochloride, acetate, metosulphate and benzyl hydrochloride salts of diamine esters. Non-limiting examples include oleyldiethyl aminoethylamide, oleylmethyl diethylenediamine methosulphate, monostearylethylene diaminotrimethylammonium methosulphate. In addition, the N-oxides of tertiary amines; derivatives of polymeric alkyldiamines, polyamine-cyanuric chloride condensates, and aminated glycerol dichlorohydrins are suitable for use as dye fixatives in the compositions of the present invention.

Cellulose Reactive Dye Fixing Agents

Another dye fixing agent suitable for use in the present invention are cellulose reactive dye fixing agents. The compositions of the present invention optionally comprise from about 0.01%, preferably from about 0.05%, more preferably from about 0.5% to about 50%, preferably to about 25%, more preferably to about 10% by weight, most preferably to about 5% by weight, of one or more cellulose reactive dye fixing agents. The cellulose reactive dye fixatives may be suitably combined with one or more dye fixatives described herein above in order to comprise a "dye fixative system".

The term "cellulose reactive dye fixing agent" is defined herein as "a dye fixative agent which reacts with the cellulose fibers upon application of heat or upon a heat treatment either in situ or by the formulator". The cellulose reactive dye fixing agents suitable for use in the present invention can be defined by the following test procedure.

Cellulose Reactivity Test (CRT)

Four pieces of fabric which are capable of bleeding their dye (e.g. 10×10 cm of knitted cotton dyed with Direct Red 80) are selected. Two swatches are used as a first control and a second control, respectively. The two remaining swatches are soaked for 20 minutes in an aqueous solution containing 1% (w/w) of the cellulose reactive dye fixing agent to be tested. The swatches are removed and thoroughly dried. One of the treated swatches which has been thoroughly dried, is passed ten times through an ironing calender which is adjusted to a "linen fabric" temperature setting. The first control swatch is also passed ten times through an ironing calender on the same temperature setting.

All four swatches (the two control swatches and the two treated swatches, one of each which has been treated by the ironing calender) are washed separately in Launder-O-Meter pots under typical conditions with a commercial detergent used at the recommended dosage for ½ hour at 60° C., followed by a thorough rinsing of 4 times 200 ml of cold water and subsequently line dried.

Color fastness is then measured by comparing the DE values of a new untreated swatch with the four swatches which have undergone the testing. DE values, the computed color difference, is defined in ASTM D2244. In general, DE values relate to the magnitude and direction of the difference between two psychophysical color stimuli defined by tristimulus values, or by chromaticity coordinates and luminance factor, as computed by means of a specified set of color-difference equations defined in the CIE 1976 CIELAB opponent-color space, the Hunter opponent-color space, the Friele-Mac Adam-Chickering color space or any equivalent color space. For the purposes of the present invention, the lower the DE value for a sample, the closer the sample is to the un-tested sample and the greater the color fastness benefit.

As the test relates to selection or a cellulose reactive dye fixing agent, if the DE value for the swatch treated in the ironing step has a value which is better than the two control swatches, the candidate is a cellulose reactive dye fixing agent for the purposes of the invention.

Typically cellulose reactive dye fixing agents are compounds which contain a cellulose reactive moiety, non limiting examples of these compounds include halogeno-triazines, vinyl sulphones, epichlorhydrine derivatives, hydroxyethylene urea derivatives, formaldehyde condensation products, polycarboxylates, glyoxal and glutaraldehyde derivatives, and mixtures thereof. Further examples can be found in "Textile Processing and Properties", Tyrone L. Vigo, at page 120 to 121, Elsevier (1997), which discloses specific electrophilic groups and their corresponding cellulose affinity.

Preferred hydroxyethylene urea derivatives include dimethyloldihydroxyethylene, urea, and dimethyl urea glyoxal. Preferred formaldehyde condensation products include the condensation products derived from formaldehyde and a group selected from an amino-group, an imino-group, a phenol group, an urea group, a cyanamide group and an aromatic group. Commercially available compounds among this class are Sandofix WE 56 ex Clariant, Zetex E ex Zeneca and Levogen BF ex Bayer. Preferred polycarboxylates derivatives include butane tetracarboxilic acid derivatives, citric acid derivatives, polyacrylates and derivatives thereof. A most preferred cellulosic reactive dye fixing agents is one of the hydroxyethylene urea derivatives class commercialized under the tradename of Indosol CR ex Clariant. Still other most preferred cellulosic reactive dye fixing agents are commercialized under the tradename Rewin DWR and Rewin WBS ex CHT R. Beitlich.

Chlorine Scavengers

The compositions of the present invention optionally comprise from about 0.01%, preferably from about 0.02%, more preferably from about 0.25% to about 15%, preferably to about 10%, more preferably to about 5% by weight, of a chlorine scavenger. In cases wherein the cation portion and the anion portion of the non-polymeric scavenger each react with chlorine, the amount of scavenger can be adjusted to fit the needs of the formulator.

Suitable chlorine scavengers include ammonium salts having the formula:

$$[(R)_3R^1N]^+X^-$$

wherein each R is independently hydrogen, $C_1$–$C_4$ alkyl, $C_1$–$C_4$ substituted alkyl, and mixtures thereof, preferably R is hydrogen or methyl, more preferably hydrogen. $R^1$ is hydrogen $C_1$–$C_9$ alkyl, $C_1$–$C_9$ substituted alkyl, and mixtures thereof, preferably R is hydrogen. X is a compatible anion, non-limiting examples include chloride, bromide, citrate, sulfate; preferably X is chloride.

Non-limiting examples of preferred chlorine scavengers include ammonium chloride, ammonium sulfate. and mixtures thereof; preferably ammonium chloride.

Crystal Growth Inhibitor

The compositions of the present invention optionally comprise from about 0.005%, preferably from about 0.5%, more preferably from about 0.1% to about 1%, preferably to about 0.5%, more preferably to about 0.25%, most preferably to about 0.2% by weight, of one or more crystal growth inhibitors. The following "Crystal Growth Inhibition Test" is used to determine the suitability of a material for use as a crystal growth inhibitor.

Crystal Growth Inhibition Test (CGIT)

The suitability of a material to serve as a crystal growth inhibitor according to the present invention can be determined by evaluating in vitro the growth rate of certain inorganic micro-crystals. The procedure of Nancollas et al., described in "Calcium Phosphate Nucleation and Growth in Solution". *Prog. Crystal Growth Charact.,* Vol 3, 77–102, (1980), incorporated herein by reference, is a method which is suitable for evaluating compounds for their crystal growth inhibition. The graph below serves as an example of a plot indicating the time delay (t-lag) in crystal formation afforded by a hypothetical crystal growth inhibitor.

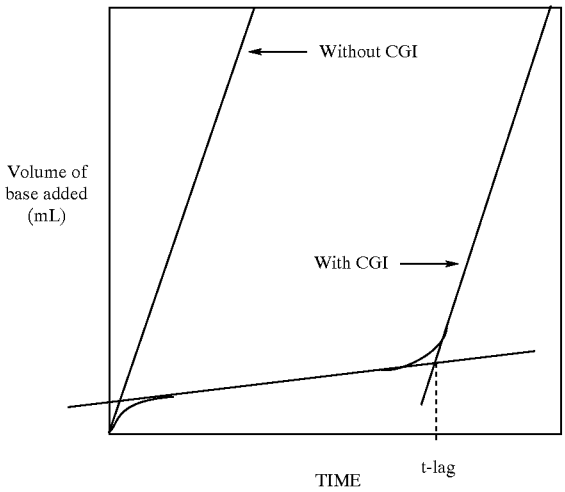

The observed t-lag provides a measure of the compound's efficiency with respect to delaying the growth of calcium phosphate crystal. The greater the t-lag, the more efficient the crystal growth inhibitor.

Exemplary Procedure

Combine in a suitable vessel, 2.1M KCl (35 mL), 0.0175M $CaCl_2$ (50 mL), 0.01M $KH_2PO_4$ (50 mL), and de-ionized water (350 mL). A standard pH electrode equipped with a Standard Calomel Reference electrode is inserted and the temperature adjusted to 37° C. while purging of the solution of oxygen. Once the temperature and pH are stabilized, a solution of the crystal growth inhibitor to be test is then added. A typical inhibitor test concentration is $1\times10^{-6}$ M. The solution is titrated to pH 7.4 with 0.05M KOH. The mixture is then treated with 5 mL's of a hydroxyapatite slurry. The hydroxyapatite slurry can be prepared by digesting Bio-Gel® HTP hydroxyapatite powder (100 g) in 1 L of distilled water the pH of which is adjusted to 2.5 by the addition of sufficient 6N HCl and subsequently heating the solution until all of the hydroxyapatite is dissolved (heating for several days may be necessary). The temperature of the solution is then maintained at about 22° C. while the pH is adjusted to 12 by the addition of a solution of 50% aqueous KOH. Once again the solution is heated and the resulting slurry is allowed to settle for two days before the supernatant is removed. 1.5 L of distilled water is added, the solution stirred, then after settling again for 2 days the supernatant is removed. This rinsing procedure is repeated six more time after which the pH of the solution is adjusted to neutrality using 2N HCl. The resulting slurry can be stored at 37° C. for eleven months.

Crystal growth inhibitors which are suitable for use in the present invention have a t-lag of at least 10 minutes, preferably at least 20 minutes, more preferably at least 50 minutes, at a concentration of $1\times10^{-6}$M. Crystal growth inhibitors are differentiated form chelating agents by the fact that crystal growth inhibitors have a low binding affinity of heavy metal ions. i.e., copper. For example, crystal growth inhibitors have an affinity for copper ions in a solution of 0.1 ionic strength when measured at 25° C., of less than 15, preferably less than 12.

The preferred crystal growth inhibitors of the present invention are selected from the group consisting of carboxylic compounds, organic diphosphonic acids, and mixtures thereof. The following are non-limiting examples of preferred crystal growth inhibitors.

Carboxylic Compounds

Non-limiting examples of carboxylic compounds which serve as crystal growth inhibitors include glycolic acid, phytic acid, polycarboxylic acids, polymers and co-polymers of carboxylic acids and polycarboxylic acids, and mixtures thereof. The inhibitors may be in the acid or salt form. Preferably the polycarboxylic acids comprise materials having at least two carboxylic acid radicals which are separated by not more than two carbon atoms (e.g., methylene units). The preferred salt forms include alkali metals; lithium, sodium, and potassium; and alkanolammonium. The polycarboxylates suitable for use in the present invention are further disclosed in U.S. Pat. Nos. 3,128,287, 3,635,830, 4,663,071, 3,923,679; 3,835,163; 4,158,635; 4,120,874 and 4,102,903, each of which is included herein by reference.

Further suitable polycarboxylates include ether hydroxypolycarboxylates, polyacrylate polymers, copolymers of maleic anhydride and the ethylene ether or vinyl methyl ethers of acrylic acid. Copolymers of 1,3,5-trihydroxybenzene, 2,4,6-trisulphonic acid, and carboxymethyloxysuccinic acid are also useful. Alkali metal salts of polyacetic acids, for example, ethylenediamine tetraacetic acid and nitrilotriacetic acid, and the alkali metal salts of polycarboxylates, for example, mellitic acid, succinic acid, oxydisuccinic acid, polymaleic acid, benzene 1,3,5-tricarboxylic acid, carboxymethyloxysuccinic acid, are suitable for use in the present invention as crystal growth inhibitors.

The polymers and copolymers which are useful as crystal growth inhibitors have a molecular weight which is preferably greater than about 500 daltons to about 100,000 daltons, more preferably to about 50,000 daltons.

Examples of commercially available materials for use as crystal growth inhibitors include, polyacrylate polymers Good-Rite® ex B F Goodrich, Acrysol® D ex Rohm & Haas, Sokalan® ex BASF, and Norasol® ex Norso Haas. Preferred are the Norasol® polyacrylate polymers, more preferred are Norasol® 410N (MW 10,000) and Norasol® 440N (MW 4000) which is an amino phosphonic acid modified polyacrylate polymer, and also more preferred is the acid form of this modified polymer sold as Norasol® QR 784 (MW 4000) ex Norso-Haas.

Polycarboxylate crystal growth inhibitors include citrates, e.g., citric acid and soluble salts thereof (particularly sodium salt), 3,3-dicarboxy-4-oxa-1,6-hexanedioates and related compounds further disclosed in U.S. Pat. No. 4,566,984 incorporated herein by reference. $C_5$–$C_{20}$ alkyl, $C_5$–$C_{20}$ alkenyl succinic acid and salts thereof, of which dodecenyl succinate, lauryl succinate, myristyl succinate, palmityl succinate, 2-dodecenylsuccinate, 2-pentadecenyl succinate, are non-limiting examples. Other suitable polycarboxylates are disclosed in U.S. Pat. Nos. 4,144,226, 3,308,067 and 3,723,322, all of which are incorporated herein by reference.

Organic Diphosphonic Acids

Organic diphosphonic acid are also suitable for use as crystal growth inhibitors. For the purposes of the present invention the term "organic diphosphonic acid" is defined as "an organo-diphosphonic acid or salt which does not comprise a nitrogen atom". Preferred organic diphosphonic acids include $C_1$–$C_4$ diphosphonic acid, preferably $C_2$ diphosphonic acid selected from the group consisting of ethylene diphosphonic acid, α-hydroxy-2 phenyl ethyl diphosphonic acid, methylene diphosphonic acid, vinylidene-1,1-diphosphonic acid, 1,2-dihydroxyethane-1,1-diphosphonic acid, hydroxy-ethane 1,1 diphosphonic acid, the salts thereof, and mixtures thereof. More preferred is hydroxyethane-1,1-diphosphonic acid (HEDP).

Fabric Abrasion Reducing Polymers

The herein disclosed polymers provide for decreased fabric abrasion as well as providing a secondary benefit related to dye transfer inhibition. The compositions of the present invention comprise from about 0.01%, preferably from about 0.1% to about 20%, preferably to about 10% by weight, of a fabric abrasion reducing polymer.

The prefered reduced abrasion polymers of the present invention are water-soluble polymers. For the purposes of the present invention the term "water-soluble" is defined as "a polymer which when dissolved in water at a level of 0.2% by weight, or less, at 25° C., forms a clear, isotropic liquid".

The fabric abrasion reducing polymers useful in the present invention have the formula:

$$[—P(D)_m—]_n$$

wherein the unit P is a polymer backbone which comprises units which are homopolymeric or copolymeric. D units are defined herein below. For the purposes of the present invention the term "homopolymeric" is defined as "a polymer backbone which is comprised of units having the same unit composition, i.e., formed from polymerization of the same monomer. For the purposes of the present invention the term "copolymeric" is defined as "a polymer backbone which is comprised of units having a different unit composition, i.e., formed from the polymerization of two or more monomers".

P backbones preferably comprise units having the formula:

$$—[CR_2—CR_2]— \text{ or } —[(CR_2)_x—L]—$$

wherein each R unit is independently hydrogen, $C_1$–$C_{12}$ alkyl, $C_6$–$C_{12}$ aryl, and D units as described herein below; preferably $C_1$–$C_4$ alkyl.

Each L unit is independently selected from heteroatom-containing moieties, non-limiting examples of which are selected from the group consisting of:

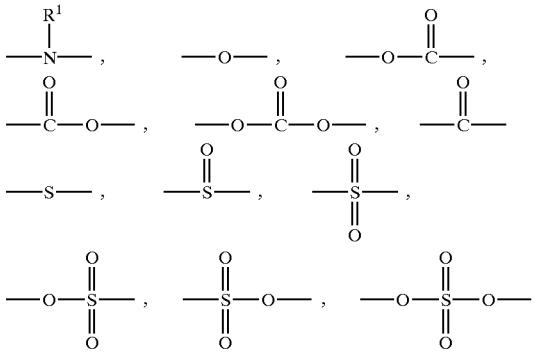

polysiloxane having the formula:

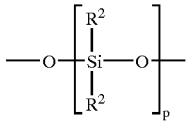

units which have dye transfer inhibition activity:

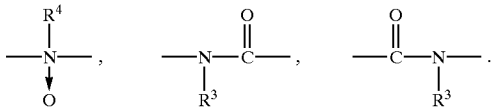

and mixtures thereof; wherein $R^1$ is hydrogen, $C_1$–$C_{12}$ alkyl, $C_6$–$C_{12}$ aryl, and mixtures thereof. $R^2$ is $C_1$–$C_{12}$ alkyl, $C_1$–$C_{12}$ alkoxy, $C_6$–$C_{12}$ aryloxy, and mixtures thereof; preferably methyl and methoxy. $R^3$ is hydrogen $C_1$–$C_{12}$ alkyl, $C_6$–$C_{12}$ aryl, and mixtures thereof; preferably hydrogen or $C_1$–$C_4$ alkyl, more preferably hydrogen. $R^4$ is $C_1$–$C_{12}$ alkyl, $C_6$–$C_{12}$ aryl, and mixtures thereof.

The backbones of the fabric abrasion reducing polymers of the present invention comprise one or more D units which are units which comprise one or more units which provide a dye transfer inhibiting benefit. The D unit can be part of the backbone itself as represented in the general formula:

$$[—P(D)_m—]_n$$

or the D unit may be incorporated into the backbone as a pendant group to a backbone unit having, for example, the formula:

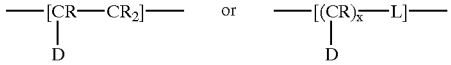

However, the number of D units depends upon the formulation. For example, the number of D units will be adjusted to provide water solubility of the polymer as well as efficacy of dye transfer inhibition while providing a polymer which has fabric abrasion reducing properties. The molecular weight of the fabric abrasion reducing polymers of the present invention are from about 500, preferably from about 1,000, more preferably from about 100,000 most preferably from 160,000 to about 6,000,000, preferably to about 2,000,000, more preferably to about 1,000,000, yet more preferably to about 500,000, most preferably to about 360,000 daltons. Therefore the value of the index n is selected to provide the indicated molecular weight, and providing for a water solubility of least 100 ppm, preferably at least about 300 ppm, and more preferably at least about 1,000 ppm in water at ambient temperature which is defined herein as 25° C.

Polymers Comprising Amide Units

Non-limiting examples of preferred D units are D units which comprise an amide moiety. Examples of polymers wherein an amide unit is introduced into the polymer via a pendant group includes polyvinylpyrrolidone having the formula:

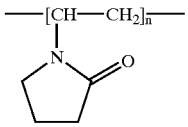

polyvinyloxazolidone having the formula:

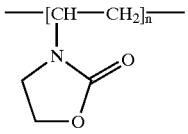

polyvinylmethyloxazolidone having the formula:

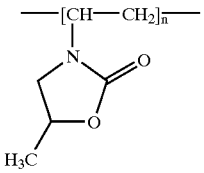

polyacrylamides and N-substituted polyacrylamides having the formula:

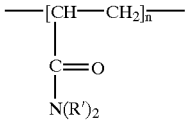

wherein each R' is independently hydrogen, $C_1$–$C_6$ alkyl, or both R' units can be taken together to form a ring comprising 4–6 carbon atoms; polymethacrylamides and N-substituted polymethacrylamides having the general formula:

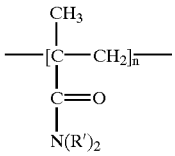

wherein each R' is independently hydrogen, $C_1$–$C_6$ alkyl, or both R' units can be taken together to form a ring comprising 4–6 carbon atoms; poly(N-acrylylglycinamide) having the formula:

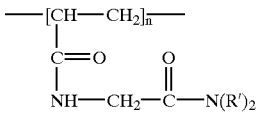

wherein each R' is independently hydrogen, $C_1$–$C_6$ alkyl, or both R' units can be taken together to form a ring comprising 4–6 carbon atoms; poly(N-methacrylylglycinamide) having the formula:

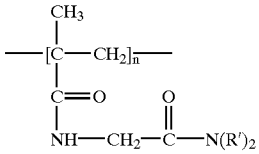

wherein each R' is independently hydrogen, $C_1$–$C_6$ alkyl, or both R' units can be taken together to form a ring comprising 4–6 carbon atoms; polyvinylurethanes having the formula:

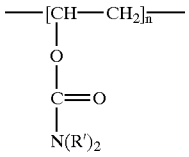

wherein each R' is independently hydrogen, $C_1$–$C_6$ alkyl, or both R' units can be taken together to form a ring comprising 4–6 carbon atoms.

An example of a D unit wherein the nitrogen of the dye transfer inhibiting moiety is incorporated into the polymer backbone is a poly(2-ethyl-2-oxazoline) having the formula:

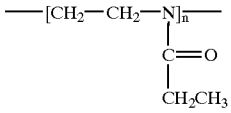

wherein the index n indicates the number of monomer residues present.

The fabric abrasion reducing polymers of the present invention can comprise any mixture of dye transfer inhibition units which provides the product with suitable properties. The preferred polymers which comprise D units which are amide moieties are those which have the nitrogen atoms of the amide unit highly substituted so the nitrogen atoms are in effect shielded to a varying degree by the surrounding non-polar groups. This provides the polymers with an amphiphilic character. Non-limiting examples include polyvinyl-pyrrolidones, polyvinyloxazolidones, N,N-disubstituted polyacrylamides, and N,N-disubstituted polymethacrylamides. A detailed description of physicochemical properties of some of these polymers are given in "Water-Soluble Synthetic Polymers: Properties and Behavior". Philip Molyneux, Vol. I, CRC Press, (1983) included herein by reference.

The amide containing polymers may be present partially hydrolyzed and/or crosslinked forms. A preferred polymeric compound for the present invention is polyvinylpyrrolidone (PVP). This polymer has an amphiphilic character with a highly polar amide group conferring hydrophilic and polar-attracting properties, and also has non-polar methylene and methine groups in the backbone and/or the ring, conferring hydrophobic properties. The rings may also provide planar alignment with the aromatic rings in the dye molecules. PVP is readily soluble in aqueous and organic solvent systems. PVP is available ex ISP, Wayne, N.J., and BASF Corp., Parsippany, N.J., as a powder or aqueous solutions in several viscosity grades, designated as. e.g., K-12, K-15, K-25, and K-30. These K-values indicate the viscosity average molecular weight, as shown below:

| PVP viscosity average molecular | K-12 | K-15 | K-25 | K-30 | K-60 | K-90 |
|---|---|---|---|---|---|---|
| weight (in thousands of daltons) | 2.5 | 10 | 24 | 40 | 160 | 360 |

PVP K-12, K-15, and K-30 are also available ex Polysciences, Inc. Warrington, Pa., PVP K-15, K-25, and K-30 and poly(2-ethyl-2-oxazoline) are available ex Aldrich Chemical Co., Inc., Milwaukee, Wis. PVP K30 (40,000) through to K90 (360,000) are also commercially available ex BASF under the tradename Luviskol or commercially available ex ISP. Still higher molecular PVP like PVP 1.3 MM, commercially available ex Aldrich is also suitable for use herein. Yet further PVP-type of material suitable for use in the present invention are polyvinylpyrrolidone-co-dimethylaminoethylmethacrylate, commercially available commercially ex ISP in a quaternised form under the tradename Gafquat® or commercially available ex Aldrich Chemical Co. having a molecular weight of approximately 1.0 MM; polyvinylpyrrolidone-co-vinyl acetate, available ex BASF under the tradename Luviskol®, available in vinvlpyrrolidone:vinylacetate ratios of from 3:7 to 7:3.

Polymers Comprising N-oxide Units

Another D unit which provides dye transfer inhibition enhancement to the fabric abrasion reducing polymers described herein, are Noxide units having the formula:

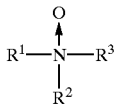

wherein $R^1$, $R^2$, and $R^3$ can be any hydrocarbyl unit (for the purposes of the present invention the term "hydrocarbyl" does not include hydrogen atom alone). The N-oxide unit may be part of a polymer, such as a polyamine, i.e., polyalkyleneamine backbone, or the N-oxide may be part of a pendant group attached to the polymer backbone. An example of a polymer which comprises an the N-oxide unit as a part of the polymer backbone is polyethyleneimine N-oxide. Non-limiting examples of groups which can comprise an N-oxide moiety include the N-oxides of certain heterocycles inter alia pyridine, pyrrole, imidazole, pyrazole, pyrazine, pyrimidine, pyridazine, piperidine, pyrrolidine, pyrrolidone, azolidine, morpholine. A preferred polymer is poly(4-vinylpyridine N-oxide, PVNO). In addition, the N-oxide unit may be pendant to the ring, for example, aniline oxide.

N-oxide comprising polymers of the present invention will preferably have a ration of N-oxidized amine nitrogen to non-oxidized amine nitrogen of from about 1:0 to about 1:2, preferably to about 1:1, more preferably to about 3:1. The amount of N-oxide units can be adjusted by the formulator. For example, the formulator may co-polymerize N-oxide comprising monomers with non N-oxide comprising monomers to arrive at the desired ratio of N-oxide to non N-oxide amino units, or the formulator may control the oxidation level of the polymer during preparation. The amine oxide unit of the polyamine Noxides of the present invention have a $Pk_a$ less than or equal to 10, preferably less than or equal to 7, more preferably less than or equal to 6. The average molecular weight of the N-oxide comprising polymers which provide a dye transfer inhibitor benefit to reduced fabric abrasion polymers is from about 500 daltons, preferably from about 100,000 daltons, more preferably from about 160,000 daltons to about 6,000,000 daltons, preferably to about 2,000,000 daltons, more preferably to about 360,000 daltons.

Polymers Comprising Amide Units and N-oxide Units

A further example of polymers which are fabric abrasion reducing polymers which have dye transfer inhibition benefits are polymers which comprise both amide units and N-oxide units as described herein above. Non-limiting examples include co-polymers of two monomers wherein the first monomer comprises an amide unit and the second monomer comprises an N-oxide unit. In addition, oligomers or block polymers comprising these units can be taken together to form the mixed amide/N-oxide polymers. However, the resulting polymers must retain the water solubility requirements described herein above.

Molecular Weight

For all the above polymer of the invention, it most preferred that they have a molecular weight in the range as described herein above. This range is typically higher than the range for polymers which render only dye transfer inhibition benefits alone. Indeed, the high molecular weight enables the abrasion occurring subsequent to treatment with the polymer to be reduced, especially in a later washing procedure. Not to be bound by theory, it is believed that that this benefit is partly due to the high molecular weight, thereby enabling the deposition of the polymer on the fabric surface and providing sufficient substantivity that the polymer is able to remain adhered to the fabric during the subsequent use and washing of the fabric. Further, it is believed that for a given charge density, increasing the molecular weight will increase the substantivity of the polymer to the fabric surface. Ideally the balance of charge density and molecular weight will provide both a sufficient rate of deposition onto the fabric surface and a sufficient adherence to the fabric during a subsequent wash cycle. Increasing molecular weight is considered preferable to increasing charge density as it allows a greater choice in the range of materials which are able to provide the benefit and avoids the negative impact that increasing charge density can have such as the attraction of soil and residue onto treated fabrics. It should be noted however that a similar benefit may be predicted from the approach of increasing charge density while retaining a lower molecular weight material.

Solvents or Liquid Carriers

The compositions of the present invention may optionally comprise from about 10%, preferably from about 12%, more preferably from about 14% to about 40%, preferably to about 35%, more preferably to about 25%. most preferably to about 20% by weight of one or more solvents (liquid carriers). These solvents are further disclosed in WO 97/03169 incorporated herein by reference. The use of solvents is especially critical when formulating clear, isotropic liquid fabric care compositions comprising cationic fabric softening actives. The solvent is selected to minimize solvent odor impact in the composition and to provide a low viscosity to the final composition. For example, isopropyl alcohol is not very effective and has a strong odor. n-Propyl alcohol is more effective, but also has a distinct odor. Several butyl alcohols also have odors but can be used for effective clarity/stability, especially when used as part of a ease of formulation solvent system to minimize their odor. The alcohols are also selected for optimum low temperature stability, that is they are able to form compositions that are liquid with acceptable low viscosities and translucent, preferably clear, down to about 40° F. (about 4.4° C.) and are able to recover after storage down to about 20° F. (about 6.7° C.).

The suitability of any solvent for the formulation of embodiments which are clear isotropic liquids, is surprisingly selective. Suitable solvents can be selected based upon their octanol/water partition coefficient (P) as defined in WO 97/03169. The solvents suitable for use herein are selected from those having a C log P of from about 0.15 to about 0.64, preferably from about 0.25 to about 0.62, and more preferably from about 0.40 to about 0.60, said ease of formulation solvent preferably being at least somewhat asymmetric, and preferably having a melting, or solidification, point that allows it to be liquid at, or near room temperature. Solvents that have a low molecular weight and are biodegradable are also desirable for some purposes. The more asymmetric solvents appear to be very desirable, whereas the highly symmetrical solvents such as 1,7-heptanediol, or 1,4-bis(hydroxymethyl) cyclohexane, which have a center of symmetry, appear to be unable to provide the essential clear compositions when used alone, even though their C log P values fall in the preferred range.

Non-limiting examples of solvents include mono-ols, C6 diols, C7 diols, octanediol isomers, butanediol derivatives, trimethylpentanediol isomers, ethylmethylpentanediol isomers, propyl pentanediol isomers, dimethylhexanediol isomers, ethylhexanediol isomers, methylheptanediol isomers, octanediol isomers, nonanediol isomers, alkyl glyceryl ethers, di(hydroxy alkyl) ethers, and aryl glyceryl ethers, aromatic glyceryl ethers, alicyclic diols and derivatives, $C_3$–$C_7$ diol alkoxylated derivatives, aromatic diols, and unsaturated diols. Preferred solvents include 1,2-hexanediol, 2-Ethyl-1,3-hexanediol, and 2,2,4-Trimethyl-1,3-pentanediol.

Enzymes

The compositions and processes herein can optionally employ one or more enzymes inter alia lipases, proteases, cellulase, amylases and peroxidases. A preferred enzyme for use herein is cellulase enzyme. Cellulases usable for use in the fabric enhancement compositions of the present invention include both bacterial and fungal types which preferably exhibit an optimal performance at a pH of from 5 to 9.5. U.S. Pat. No. 4,435,307 Barbesgaard et al., issued Mar. 6, 1984, included herein by reference, discloses suitable fungal cellulases ex *Humicola insolens* or Humicola strain DSM1800 or a cellulase 212-producing fungus belonging to the genus Aeromonas, and cellulase enzymes extracted from the hepatopancreas of a marine mollusk, Dolabella Auricula Solander. Suitable cellulases are also disclosed in GB-A-2,075,028; GB-A-2,095,275 and DE-OS-2,247,832 each of which is included herein by reference. CAREZYME® and CELLUZYME® (Novo) are especially useful. Other suitable cellulases are also disclosed in WO 91/17243 to Novo, WO 96/34092, WO 96/34945 and EP-A-0,739,982. Compositions may comprise up to 5 mg by weight, more typically 0.01 mg to 3 mg, of active enzyme per gram of the composition. Stated otherwise, the compositions herein will typically comprise from 0.001%, preferably from 0.01% to 5%, preferably to 1% by weight, of a commercial enzyme preparation. In the particular cases where activity of the enzyme preparation can be defined otherwise such as with cellulases, corresponding activity units are preferred (e.g. CEVU or cellulase Equivalent Viscosity Units). For instance, the compositions of the present invention can contain cellulase enzymes at a level equivalent to an activity from 0.5 to 1000 CEVU/gram of composition. Cellulase enzyme preparations used for the purpose of formulating the compositions of this invention typically have an activity comprised between 1,000 and 10,000 CEVU/gram in liquid form, around 1,000 CEVU/gram in solid form.

Polyolefin dispersion

The compositions of the present invention optionally comprise from about 0.01%, preferably from about 0.1% to about 8%, preferably to about 5%, more preferably to about 3% by weight, of a poly olefin emulsion or suspension in order to provide anti-wrinkle and improved water absorbency benefits to the fabrics treated by the fabric care compositions of the present invention. Preferably, the polyolefin is a polyethylene, polypropylene or mixtures thereof. The polyolefin may be at least partially modified to contain various functional groups, such as carboxyl, carbonyl, ester, ether, alkylamide, sulfonic acid or amide groups. More preferably, the polyolefin employed in the present invention is at least partially carboxyl modified or, in other words, oxidized. In particular, oxidized or carboxyl modified polyethylene is preferred in the compositions of the present invention.

When considering ease of formulation, the polyolefin is preferably introduced as a suspension or an emulsion of polyolefin dispersed by use of an emulsifying agent. The polyolefin suspension or emulsion preferably has from 1, preferably from 10%, more preferably from 15% to 50%, more preferably to 35% more preferably to 30% by weight, of polyolefin in the emulsion. The polyolefin preferably has a molecular weight of from 1,000, preferably from 4,000 to 15,000, preferably to 10,000. When an emulsion is employed, the emulsifier may be any suitable emulsification or suspending agent. Preferably, the emulsifier is a cationic, nonionic, zwitterionic or anionic surfactant or mixtures thereof. Most preferably, any suitable cationic, nonionic or anionic surfactant may be employed as the emulsifier. Preferred emulsifiers are cationic surfactants such as the fatty amine surfactants and in particular the ethoxylated fatty amine surfactants. In particular, the cationic surfactants are preferred as emulsifiers in the present invention. The polyolefin is dispersed with the emulsifier or suspending agent in a ratio of emulsifier to polyolefin of from 1:10 to 3:1. Preferably, the emulsion includes from 0.1, preferably from 1%, more preferably from 2.5% to 50%, preferably to 20%, more preferably to 10% by weight, of emulsifier in the polyolefin emulsion. Polyethylene emulsions and suspensions suitable for use in the present invention are available under the tradename VELUSTROL exHOECHST Aktiengesellschaft of Frankfurt am Main, Germany. In particular, the polyethylene emulsions sold under the tradename VELUSTROL PKS, VELUSTROL KPA, or VELUSTROL P40 may be employed in the compositions of the present invention.

Stabilizers

The compositions of the present invention can optionally comprise from about 0.01%, preferably from about 0.035% to about 0.2%, more preferably to about 0.1% for antioxidants, preferably to about 0.2% for reductive agents, of a stabilizer. The term "stabilizer," as used herein, includes antioxidants and reductive agents. These agents assure good odor stability under long term storage conditions for the compositions and compounds stored in molten form. The use of antioxidants and reductive agent stabilizers is especially critical for low scent products (low perfume).

Non-limiting examples of antioxidants that can be added to the compositions of this invention include a mixture of ascorbic acid, ascorbic palmitate, propyl gallate, ex Eastman Chemical Products. Inc., under the trade names Tenox® PG and Tenox S-1; a mixture of BHT (butylated hydroxytoluene), BHA (butylated hydroxyanisole), propyl gallate, and citric acid, ex Eastman Chemical Products, Inc., under the trade name Tenox-6; butylated hydroxytoluene, available from UOP Process Division under the trade name Sustane® BHT; tertiary butylhydroquinone, Eastman Chemical Products, Inc., as Tenox TBHQ; natural tocopherols, Eastman Chemical Products, Inc., as Tenox GT-1/GT-2; and butylated hydroxyanisole, Eastman Chemical Products, Inc., as BHA; long chain esters ($C_8$–$C_{22}$) of gallic acid, e.g., dodecyl gallate; Irganox® 1010; Irganox® 1035; Irganox® B 1171; Irganox® 1425; Irganox® 3114; Irganox® 3125; and mixtures thereof; preferably Irganox® 3125, Irganox® 1425, Irganox® 3114, and mixtures thereof; more preferably Irganox® 3125 alone or mixed with citric acid and/or other chelators such as isopropyl citrate, Dequest® 2010, ex Monsanto with a chemical name of 1-hydroxyethylidene-1,1-diphosphonic acid (etidronic acid), and Tiron®, ex Kodak with a chemical name of 4,5-dihydroxy-m-benzene-sulfonic acid/sodium salt, EDDS, and DTPA®, ex Aldrich with a chemical name of diethylenetriaminepentaacetic acid.

Fabric Softening Actives

The compositions of the present invention comprise at least about 1%, preferably from about 10%, more preferably from about 20% to about 80%, more preferably to about 60% by weight, of the composition of one or more fabric softener actives.

The preferred fabric softening actives according to the present invention are amines having the formula:

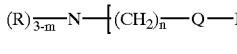

quaternary ammonium compounds having the formula:

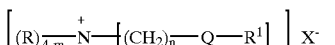

and mixtures thereof, wherein each R is independently $C_1$–$C_6$ alkyl, $C_1$–$C_6$ hydroxyalkyl, benzyl, and mixtures thereof; $R^1$ is preferably $C_{11}$–$C_{22}$ linear alkyl, $C_{11}$–$C_{22}$ branched alkyl, $C_{11}$–$C_{22}$ linear alkenyl, $C_{11}$–$C_{22}$ branched alkenyl, and mixtures thereof; Q is a carbonyl moiety independently selected from the units having the formula:

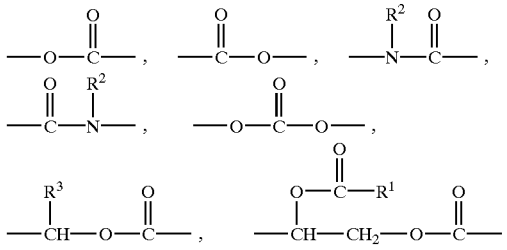

wherein $R^2$ is hydrogen, $C_1$–$C_4$ alkyl, preferably hydrogen; $R^3$ is $C_1$–$C_4$ alkyl, preferably hydrogen or methyl; preferably Q has the formula:

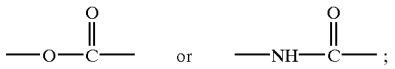

X is a softener compatible anion, preferably the anion of a strong acid, for example, chloride, bromide, methylsulfate, ethylsulfate, sulfate, nitrate and mixtures thereof, more preferably chloride and methyl sulfate. The anion can also, but less preferably, carry a double charge, in which case $X^{(-)}$ represents half a group. The index m has a value of from 1 to 3; the index n has a value of from 1 to 4, preferably 2 or 3, more preferably 2.

One embodiment of the present invention provides for amines and quaternized amines having two or more different values for the index n per molecule, for example, a softener active prepared from the starting amine methyl(3-aminopropyl)(2-hydroxyethyl)amine.

More preferred softener actives according to the present invention have the formula:

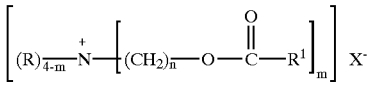

wherein the unit having the formula:

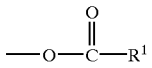

is a fatty acyl moiety. Suitable fatty acyl moieties for use in the softener actives of the present invention are derived from sources of triglycerides including tallow, vegetable oils and/or partiality hydrogenated vegetable oils including inter alia canola oil, safflower oil, peanut oil, sunflower oil, corn oil, soybean oil, tall oil, rice bran oil. Yet more preferred are the Diester Quaternary Ammonium Compounds (DEQA's) wherein the index m is equal to 2.

The $R^1$ units are typically mixtures of linear and branched chains of both saturated and unsaturated aliphatic fatty acids, an example of which (canola oil), is described in Table I herein below.

TABLE I

| Fatty acyl unit | % |
|---|---|
| C14 | 0.1 |
| C16 | 5.4 |
| C16:1 | 0.4 |
| C18 | 5.7 |
| C18:1 | 67.0 |
| C18:2 | 13.5 |
| C18:3 | 2.7 |
| C20 | 0.5 |
| C20:1 | 4.6 |

The formulator, depending upon the desired physical and performance properties of the final fabric softener active, can choose any of the above mentioned sources of fatty acyl moieties, or alternatively, the formulator can mix sources of triglyceride to form a "customized blend". However, those skilled in the art of fats and oils recognize that the fatty acyl composition may vary, as in the case of vegetable oil, from crop to crop, or from variety of vegetable oil source to variety of vegetable oil source. DEQA's which are prepared using fatty acids derived from natural sources are preferred.

A preferred embodiment of the present invention provides softener actives comprising $R^1$ units which have at least about 3%, preferably at least about 5%, more preferably at least about 10%, most preferably at least about 15% $C_{11}$–$C_{22}$ alkenyl, including polyalkenyl (polyunsaturated) units inter alia oleic, linoleic, linolenic.

For the purposes of the present invention the term "mixed chain fatty acyl units" is defined as "a mixture of fatty acyl units comprising alkyl and alkenyl chains having from 10 carbons to 22 carbon atoms including the carbonyl carbon atom, and in the case of alkenyl chains, from one to three double bonds, preferably all double bonds in the cis configuration". With regard to the $R^1$ units of the present invention, it is preferred that at least a substantial percentage of the fatty acyl groups are unsaturated, e.g., from about 25%, preferably from about 50% to about 70%, preferably to about 65%. The total level of fabric softening active containing polyunsaturated fatty acyl groups can be from about 3%, preferably from about 5%, more preferably from about 10% to about 30%, preferably to about 25%, more preferably to about 18%. As stated herein above cis and trans isomers can be used, preferably with a cis/trans ratio is of from 1:1, preferably at least 3:1, and more preferably from about 4:1 to about 50:1, more preferably about 20:1, however, the minimum being 1:1.

The level of unsaturation contained within the tallow, canola, or other fatty acyl unit chain can be measured by the Iodine Value (IV) of the corresponding fatty acid, which in the present case should preferably be in the range of from 5 to 100 with two categories of compounds being distinguished. having a IV below or above 25.

Indeed, for compounds having the formula:

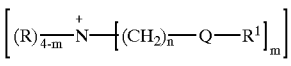

derived from tallow fatty acids, when the Iodine Value is from 5 to 25, preferably 15 to 20, it has been found that a cis/trans isomer weight ratio greater than about 30/70, preferably greater than about 50/50 and more preferably greater than about 70/30 provides optimal concentrability.

For compounds of this type made from tallow fatty acids having a Iodine Value of above 25, the ratio of cis to trans isomers has been found to be less critical unless very high concentrations are needed. A further preferred embodiment of the present invention comprises DEQA's wherein the average Iodine Value for $R^1$ is approximately 45.

The $R^1$ units suitable for use in the isotropic liquids present invention can be further characterized in that the Iodine Value (IV) of the parent fatty acid, said IV is preferably from about 10, more preferably from about 50, most preferably from about 70, to a value of about 140, preferably to about 130, more preferably to about 115. However, formulators, depending upon which embodiment of the present invention they choose to execute, may wish to add an amount of fatty acyl units which have Iodine Values outside the range listed herein above. For example, "hardened stock" (IV less than or equal to about 10) may be combined with the source of fatty acid admixture to adjust the properties of the final softener active.

A prefered source of fatty acyl units, especially fatty acyl units having branching, for example, "Guerbet branching", methyl, ethyl, etc. units substituted along the primary alkyl chain, synthetic sources of fatty acyl units are also suitable. For example, the formulator may with to add one or more fatty acyl units having a methyl branch at a "non-naturally occuring" position, for example, at the third carbon of a $C_{17}$ chain. What is meant herein by the term "non-naturally occuring" is "acyl units which are not found in significant (greater than about 0.1%) quantities is common fats and oils which serve as feedstocks for the source of triglycerides described herein." If the desired branched chain fatty acyl unit is unavailable from readily available natural feedstocks, therefore, synthetic fatty acid can be suitably admixed with other synthetic materials or with other natural triglyceride derived sources of acyl units.

The following are examples of preferred softener actives according to the present invention.

N,N-di(tallowyl-oxy-ethyl)-N,N-dimethyl ammonium chloride;

N,N-di(canolyl-oxy-ethyl)-N,N-dimethyl ammonium chloride;

N,N-di(tallowyl-oxy-ethyl)-N-methyl, N-(2-hydroxyethyl) ammonium methyl sulfate;

N,N-di(canolyl-oxy-ethyl)-N-methyl, N-(2-hydroxyethyl) ammonium methyl sulfate;

N,N-di(tallowylamidoethyl)-N-methyl, N-(2-hydroxyethyl) ammonium methyl sulfate;

N,N-di(2-tallowyloxy-2-oxo-ethyl)-N,N-dimethyl ammonium chloride;

N,N-di(2-canolyloxy-2-oxo-ethyl)-N,N-dimethyl ammonium chloride;

N,N-di(2-tallowyloxyethylcarbonyloxyethyl)-N,N-dimethyl ammonium chloride;

N,N-di(2-canolyloxyethylcarbonyloxyethyl)-N,N-dimethyl ammonium chloride;

N-(2-tallowoyloxy-2-ethyl)-N-(2-tallowyloxy-2-oxo-ethyl)-N,N-dimethyl ammonium chloride;

N-(2-canolyloxy-2-ethyl)-N-(2-canolyloxy-2-oxo-ethyl)-N,N-dimethyl ammonium chloride;

N,N,N-tri(tallowyl-oxy-ethyl)-N-methyl ammonium chloride:

N,N,N-tri(canolyl-oxy-ethyl)-N-methyl ammonium chloride;

N-(2-tallowyloxy-2-oxoethyl)-N-(tallowyl)-N,N-dimethyl ammonium chloride;

N-(2-canolyloxy-2-oxoethyl)-N-(canolyl)-N,N-dimethyl ammonium chloride;

1,2-ditallowyloxy-3-N,N,N-trimethylammoniopropane chloride; and 1,2-dicanolyloxy-3-N,N,N-trimethylammoniopropane chloride;

and mixtures of the above actives.

Particularly preferred is N,N-di(tallowoyl-oxy-ethyl)-N,N-dimethyl ammonium chloride, where the tallow chains are at least partially unsaturated and N,N-di(canoloyl-oxy-ethyl)-N,N-dimethyl ammonium chloride, N,N-di(tallowyl-oxy-ethyl)-N-methyl, N-(2-hydroxyethyl) ammonium methyl sulfate; N,N-di(canolyl-oxy-ethyl)-N-methyl, N-(2-hydroxyethyl) ammonium methyl sulfate; and mixtures thereof.

Additional fabric softening agents useful herein are described in U.S. Pat. No. 5,643,865 Mermelstein et al., issued Jul. 1, 1997; U.S. Pat. No. 5,622,925 de Buzzaccarini et al., issued Apr. 22, 1997; U.S. Pat. No. 5,545,350 Baker et al., issued Aug. 13, 1996; U.S. Pat. No. 5,474,690 Wahl et al., issued Dec. 12, 1995; U.S. Pat. No. 5,417,868 Turner et al., issued Jan. 27, 1994; U.S. Pat. No. 4,661,269 Trinh et al., issued Apr. 28, 1987; U.S. Pat. No. 4,439,335 Burns, issued Mar. 27, 1984; U.S. Pat. No. 4,401,578 Verbruggen, issued Aug. 30, 1983; U.S. Pat. No. 4,308,151 Cambre, issued Dec. 29, 1981; U.S. Pat. No. 4,237,016 Rudkin et al., issued Oct. 27, 1978; U.S. Pat. No. 4,233,164 Davis, issued Nov. 11, 1980; U.S. Pat. No. 4,045,361 Watt et al., issued Aug. 30, 1977; U.S. Pat. No. 3,974,076 Wiersema et al., issued Aug. 10, 1976; U.S. Pat. No. 3,886,075 Bernadino, issued May 6, 1975; U.S. Pat. No. 3,861,870 Edwards et al., issued Jan. 21, 1975; and European Patent Application publication No. 472,178, by Yamamura et al., all of said documents being incorporated herein by reference.

Principal Solvent

The compositions of the present invention, preferably the isotropic liquid embodiments thereof, may also optionally comprise a principal solvent. The level of principal solvent present in the compositions of the present invention is typically less than about 95%, preferably less than about 50%, more preferably less than about 25%, most preferably less than about 15% by weight. Some embodiments of isotropic liquid embodiments of the present invention may comprise no principal solvent but may substitute instead a suitable nonionic surfactant.

The principal solvents of the present invention are primarily used to obtain liquid compositions having sufficient clarity and viscosity. Principal solvents must also be selected to minmize solvent odor impact in the composition. For example, isopropyl alcohol is not an effective principal solvent in that it does not serve to produce a composition having suitable viscosity. Isopropanol also fails as a suitable principal solvent because it has a relatively strong odor.

Principal solvents are also selected for their ability to provide stable compositions at low temperatures, preferably compositions comprising suitable principal solvents are clear down to about 4° C. and have the ability to fully recover their clarity if stored as low as about 7° C.

The principal solvents according to the present invention are selected base upon their octanol/water partition coefficient (P). The octanol/water partition coefficient is a measure of the ratio of the concentrations of a particular principal solvent in octanol and water at equilibrium. The partition coefficients are conveniently expressed and reported as their logarithm to the base 10; log P.

The log P of many principal solvent species has been reported; for example, the Ponmona92 database, available from Daylight Chemical Information Systems, Inc.(Daylight CIS), contains many, along with citations to the original literature.

However, the log P values are most conveniently calculated by the "C LOG P" program, also available from Daylight CIS. This program also lists experimental log P values when they are available in the Pomona92 database. The "calculated log P" (C log P) is determined by the fragment approach of Hansch and Leo (cf., A. Leo, in Comprehensive Medicinal Chemistry, Vol. 4. C. Hansch. P. G. Sammens, J. B. Taylor and C. A. Ransden, Eds., p. 295, Pergamon Press, 1990, incorporated herein by reference). The fragment approach is based on the chemical structure of each HR species, and takes into account the numbers and types of atoms, the atom connectivity, and chemical bonding C log P values are the most reliable and widely used estimates for octanol water partitioning. It will be understood by those skilled in the art that experimental log P values could also be used. Experimental log P values represent a less preferred embodiment of the invention. Where experimental log P values are used, the one hour log P values are preferred. Other methods that can be used to compute C log P include, e.g., Crippen's fragmentation method as disclosed in *J. Chem. Inf. Comput. Sci.,* 27a,21 (1987); Viswanadhan's fragmentation method as disclosed in *J. Chem. Inf. Comput. Sci.,* 29, 163 (1989); and Broto's method as disclosed in *Eur. J. Med. Chem.—Chim. Theor.,* 19, 71 (1984).

The principal solvents suitable for use in the present invention are selected from those having a C log P of from about 0.15 to about 1, preferably from about 0.15 to about 0.64, more preferably from about 0.25 to about 0.62, most preferably form about 0.4 to about 0.6. Preferably the principal solvent is at least to some degree an asymmetric molecule, preferably having a melting, or solidification point which allows the principal solvent to be liquid at or near room temperature. Low molecular weight principal solvents may be desirable for some embodiments. More preferred molecules are highly asymmetrical.

A further description of principal solvents suitable for use in the isotropic liquid compositions of the present invention are thoroughly described in WO 97/03169 "Concentrated, Stable Fabric Softening Composition", published Jan. 30, 1997 and assigned to the Procter & Gamble Co.; WO 97/03170 "Concentrated, Water Dispersible, Stable, Fabric Softening Composition", published Jan. 30, 1997 and assigned to the Procter & Gamble Co.; and WO 97/34972 "Fabric Softening Compound/Composition", published Sep. 25, 1997 and assigned to the Procter & Gamble Co. all included herein by reference.

Hydrophobic Dispersant

A preferred composition of the present invention comprises from about 0.1%, preferably from about 5%, more preferably form about 10% to about 80%, preferably to about 50%, more preferably to about 25% by weight, of a hydrophobic polyamine dispersant having the formula:

$$[(R^1)_2N—R]_w[\overset{\overset{R^1}{|}}{N}—R]_x[\overset{\overset{B}{|}}{N}—R]_yN(R^1)_2$$

wherein R, $R^1$ and B are suitably described in U.S. Pat. No. 5,565,145 Watson et al., issued Oct. 15, 1996 incorporated herein by reference, and w, x, and y have values which provide for a backbone prior to substitution of preferably at least about 1200 daltons, more preferably 1800 daltons.

$R^1$ units are preferably alkyleneoxy units having the formula:

$$—(CH_2CHR'O)_m(CH_2CH_2O)_nH$$

wherein R' is methyl or ethyl, m and n are preferably from about 0 to about 50, provided the average value of alkoxylation provided by m+n is at least about 0.5.

A further description of polyamine dispersants suitable for use in the present invention is found in U.S. Pat. No. 4,891,160 Vander Meer, issued Jan. 2, 1990; U.S. Pat. No. 4,597,898, Vander Meer, issued Jul. 1, 1986; European Patent Application 111,965, Oh and Gosselink, published Jun. 27, 1984; European Patent Application 111,984, Gosselink, published Jun. 27, 1984; European Patent Application 112,592, Gosselink, published Jul. 4, 1984; U.S. Pat. No. 4,548,744, Connor, issued Oct. 22, 1985; and U.S. Pat. No. 5,565,145 Watson et al., issued Oct. 15, 1996; all of which are included herein by reference. However, any suitable clay/soil dispersent or anti-redepostion agent can be used in the laundry compositions of the present invention.

Electrolyte

The fabric softening embodiments of the compositions of the present invention, especially clear, isotropic liquid fabric softening compositions, may also optionally, but preferably comprise, one or more electrolytes for control of phase stability, viscosity, and/or clarity. For example, the presence of certain electrolytes inter alia calcium chloride, magnesium chloride may be key to insuring initial product clarity and low viscosity, or may affect the dilution viscosity of liquid embodiments, especially isotropic liquid embodiments. Not wishing to be limited by theory, but only wishing to provide an example of a circumstance wherein the formulator must insure proper dilution viscosity, includes the following example. Isotropic or non-isotropic liquid fabric softener compositions can be introduced into the rinse phase of laundry operations via an article of manufacture designed to dispense a measured amount of said composition. Typically the article of manufacture is a dispenser which delivers the softener active only during the rinse cycle. These dispensers are typically designed to allow an amount of water equal to the volume of softener composition to enter into the dispenser to insure complete delivery of the softener composition. An electrolyte may be added to the compositions of the present invention to insure phase stability and prevent the diluted softener composition from "gelling out" or from undergoing an undesirable or unacceptable viscosity increase. Prevention of gelling or formation of a "swelled", high viscosity solution insures thorough delivery of the softener composition.

However, those skilled in the art of fabric softener compositions will recognize that the level of electrolyte is also influenced by other factors inter alia the type of fabric softener active, the amount of principal solvent, and the level and type of nonionic surfactant. For example, triethanol amine derived ester quaternary amines suitable for use as softener actives according to the present invention are typically manufactured in such a way as to yield a distribution of mono-, di-, and tri-esterified quaternary ammonium compounds and amine precursors. Therefore, as in this example, the variability in the distribution of mono-, di-, and tri-esters and amines may predicate a different level of electrolyte. Therefore, the formulator must consider all of the ingredients, namely, softener active, nonionic surfactant, and in the case of isotropic liquids, the principal solvent type and level, as well as level and identity of adjunct ingredients before selecting the type and/or level of electrolyte.

A wide variety of ionizable salts can be used. Examples of suitable salts are the halides of the Group IA and IIA metals of the Periodic Table of the elements, e.g., calcium chloride, sodium chloride, potassium bromide, and lithium chloride. The ionizable salts are particularly useful during the process of mixing the ingredients to make the compositions herein, and later to obtain the desired viscosity. The amount of ionizable salts used depends on the amount of active ingredients used in the compositions and can be adjusted according to the desires of the formulator. Typical levels of salts used to control the composition viscosity are from about 20 to about 10,000 parts per million (ppm), preferably from about 20 to about 5,000 ppm, of the composition.

Alkylene polyammonium salts can be incorporated into the composition to give viscosity control in addition to or in place of the water-soluble, ionizable salts above, In addition, these agents can act as scavengers, forming ion pairs with anionic detergent carried over from the main wash, in the rinse, and on the fabrics, and can improve softness performance. These agents can stabilized the viscosity over a broader range of temperature, especially at low temperatures, compared to the inorganic electrolytes. Specific examples of alkylene polyammonium salts include L-lysine, monohydrochloride and 1,5-diammonium 2-methyl pentane dihydrochloride.

Cationic Charge Booster System

The compositions of the present invention may optionally comprise from about 0.2%, preferably from about 5% to about 10%, preferably to about 7% by weight, of a charge booster system. Typically, ethanol is used to prepare many of the below listed ingredients and is therefore a source of solvent into the final product formulation. The formulator is not limited to ethanol, but instead can add other solvents inter alia hexyleneglycol to aid in formulation of the final composition. This is especially true in clear, translucent, isotropic compositions.

Cationic Charge Booster Admixtures

One type of preferred cationic charge booster system of the present invention is an admixture of two or more di-amino compounds wherein at least one of said di-amino compounds is a di-quaternary ammonium compound.

Preferably said charge booster system is the admixture of di-amino compounds which results from a process comprising the steps of:

i) reacting one equivalent of a diamine having the formula:

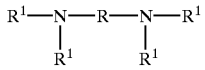

wherein R is $C_2$–$C_{12}$ alkylene; each $R^1$ is independently hydrogen, $C_1$–$C_4$ alkyl, a unit having the formula:

$$—R^2—Z$$

wherein $R^2$ is $C_2$–$C_6$ linear or branched alkylene, $C_2$–$C_6$ linear or branched hydroxy substituted alkylene, $C_2$–$C_6$ linear or branched amino substituted alkylene, and mixtures thereof; Z is hydrogen, —OH, —$NH_2$, and mixtures thereof; with from about 0.1 equivalent to about 8 equivalents of an acylating unit to form an acylated di-amino admixture; and ii) reacting said acylated di-amino admixture with from 0.1 equivalents to 2 equivalents of a quaternizing agent to form said cationic charge booster system.

Step (i) of the present cationic charge booster producing process, is an acylation step. The acylation of the amino compound may be conducted under any conditions which allow the formulator to prepare the desired final cationic admixture or an admixture which has the desired final charge boosting properties.

Step (ii) of the present cationic charge booster producing process, is the quaternization step. The formulator may use any quaternizing agent which provides an admixture having the desired charge boosting properties. The choice of from 0.1 equivalents to 2 equivalents of quaternizing agent will provide the formulator with a wide array of cationically charged di-amines in the final admixture.

Non-limiting examples of acylating agents suitable for use in the present invention include, acylating agents selected from the group consisting of:

a) acyl halides having the formula:

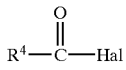

b) an ester having the formula:

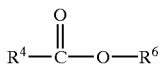

c) anhydrides having the formula:

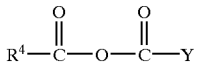

d) carboxylic/carbonic anhydrides having the formula:

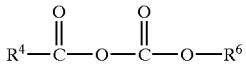

e) acyl azides having the formula:

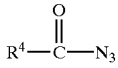

f) and mixtures thereof;

wherein $R^4$ is $C_6$–$C_{22}$ linear or branched, substituted or unsubstituted alkyl, $C_6$–$C_{22}$ linear or branched, substituted or unsubstituted alkenyl, or mixtures thereof; Hal is a halogen selected from chlorine, bromine, or iodine; $R^6$ is $R^4$, $C_1$–$C_5$ linear or branched alkyl; Y is $R^4$, —$CF_3$, —$CCl_3$, and mixtures thereof.

An example of a preferred process comprises the reaction of an amine having the formula:

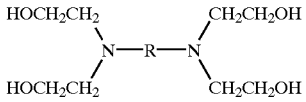

wherein R is hexamethylene, with about two equivalents of an acylating agent to form a partially acylated diamine admixture, followed by reaction of said admixture with from about 1.25 to about 1.75 equivalents of a quaternizing unit, preferably dimethyl sulfate.

Non-limiting examples of preferred di-amines which comprise the cationic charge booster svstems of the present invention include:

i) one or more diamines having the formula:

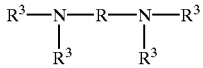

ii) one or more quaternary ammonium compounds having the formula:

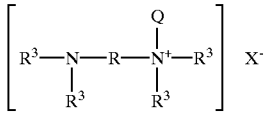

iii) one or more di-quaternary ammonium compounds having the formula:

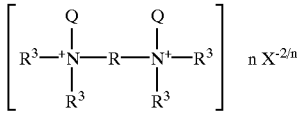

wherein R is $C_2$–$C_{12}$ alkylene, preferably $C_2$–$C_8$ alkylene, more preferably hexamethylene; each $R^3$ is independently $R^1$, an acyl comprising unit having the formula:

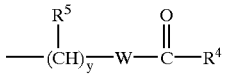

wherein $R^4$ is $C_6$–$C_2$ linear or branched, substituted or unsubstituted alkyl, $C_6$–$C_{22}$ linear or branched, substituted or unsubstituted alkenyl, or mixtures thereof; and mixtures thereof; each $R^5$ is independently hydrogen, —OH, —$NH_2$, —$(CH_2)_z$WC(O)$R^4$, and mixtures thereof; Q is a quaternizing unit selected from the group consisting of $C_1$–$C_{12}$ alkyl, benzyl, and mixtures thereof; W is —O—, —NH—, and mixtures thereof; X is a water soluble cation; the index n is 1 or 2; y is from 2 to 6; z is from 0 to 4; y+z is less than 7.

Suitable sources of acyl units which comprise the cationic charge booster systems include acyl units which are derived from sources of triglycerides selected from the group consisting of tallow, hard tallow, lard, coconut oil, partially hydrogenated coconut oil, canola oil, partially hydrogenated canola oil, safflower oil, partially hydrogenated safflower oil, peanut oil, partially hydrogenated peanut oil, sunflower oil, partially hydrogenated sunflower oil, corn oil, partially hydrogenated corn oil, soybean oil, partially hydrogenated soybean oil, tall oil, partially hydrogenated tall oil, rice bran oil, partially hydrogenated rice bran oil, synthetic triglyceride feedstocks and mixtures thereof.

Preferably at least two $R^3$ units are units having the formula:

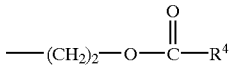

wherein $R^4$ comprises an acyl which is derived from a triglyceride source selected from the group consisting of hard tallow, soft tallow, canola, oleoyl, and mixtures thereof; Q is methyl; X is a water soluble cation; the index n is 2.

The following is an example of a di-amino admixture suitable for use as a cationic charge boosting system according to the present invention.

i) diamines having the formula:

$(HOCH_2CH_2)_2N(CH_2)_6N(CH_2CH_2OH)_2$ $(HOCH_2CH_2)_2N(CH_2)_6N(CH_2CH_2OH)(CH_2CH_2OCR^4)$ $(R^4COCH_2CH_2)(HOCH_2CH_2)N(CH_2)_6N(CH_2CH_2OH)(CH_2CH_2OCR^4)$ $(R^4COCH_2CH_2)(HOCH_2CH_2)N(CH_2)_6N(CH_2CH_2OCR^4)_2$ $(R^4COCH_2CH_2)(HOCH_2CH_2)N(CH_2)_6N(CH_2CH_2OH)_2$ $(R^4COCH_2CH_2)_2N(CH_2)_6N(CH_2CH_2OCR^4)_2$ ii) quaternary ammonium compounds having the formula:

$(HOCH_2CH_2)_2N^+(CH_3)(CH_2)_6N(CH_2CH_2OH)_2$ $(HOCH_2CH_2)_2N^+(CH_3)(CH_2)_6N(CH_2CH_2OH)(CH_2CH_2OCR^4)$ $(R^4COCH_2CH_2)(HOCH_2CH_2)N^+(CH_3)(CH_2)_6N(CH_2CH_2OH)_2$ $(R^4COCH_2CH_2)(HOCH_2CH_2)N^+(CH_3)(CH_2)_6N(CH_2CH_2OH)(CH_2CH_2OCR^4)$ $(HOCH_2CH_2)_2N^+(CH_3)(CH_2)_6N(CH_2CH_2OCR^4)_2$ $(R^4COCH_2CH_2)_2N^+(CH_3)(CH_2)_6N(CH_2CH_2OH)_2$ $(R^4COCH_2CH_2)_2N^+(CH_3)(CH_2)_6N(CH_2CH_2OH)(CH_2CH_2OCR^4)$ $(R^4COCH_2CH_2)(HOCH_2CH_2)N^+(CH_3)(CH_2)_6N(CH_2CH_2OCR^4)_2$ $(R^4COCH_2CH_2)_2N^+(CH_3)(CH_2)_6N(CH_2CH_2OCR^4)_2$ iii) di-quaternary ammonium compounds having the formula:

$(HOCH_2CH_2)_2N^+(CH_3)(CH_2)_6N^+(CH_3)(CH_2CH_2OH)_2$ $(R^4COCH_2CH_2)(HOCH_2CH_2)N^+(CH_3)(CH_2)_6N^+(CH_3)(CH_2CH_2OH)_2$ $(R^4COCH_2CH_2)(HOCH_2CH_2)N^+(CH_3)(CH_2)_6N^+(CH_3)(CH_2CH_2OH)(CH_2CH_2OCR^4)$ $(R^4COCH_2CH_2)_2N^+(CH_3)(CH_2)_6N^+(CH_3)(CH_2CH_2OH)(CH_2CH_2OCR^4)$ $(R^4COCH_2CH_2)_2N^+(CH_3)(CH_2)_6N^+(CH_3)(CH_2CH_2OCR^4)_2$ wherein the acyl unit $—C(O)R^4$ is derived from canola.

Non-admixture Cationic Charge Boosters

When formulating non-admixture cationic charge booster systems into the fabric enhancement or fabric care compositions of the present invention the following are non-limiting preferred examples.

i) Quaternary Ammonium Compounds

A preferred composition of the present invention comprises at least about 0.2%, preferably from about 0.2% to about 10%, more preferably from about 0.2% to about 5% by weight, of a cationic charge booster having the formula:

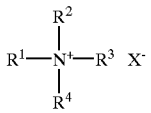

wherein $R^1$, $R^2$, $R^3$, and $R^4$ are each independently $C_1$–$C_{22}$ alkyl, $C_3$–$C_{22}$ alkenyl, $R^5—Q—(CH_2)_m—$, wherein $R^5$ is $C_1$–$C_{22}$ alkyl, and mixtures thereof, m is from 1 to about 6; X is an anion.

Preferably $R^1$ is $C_6$–$C_{22}$ alkyl, $C_6$–$C_{22}$ alkenyl, and mixtures thereof, more preferably $C_{11}$–$C_{18}$ alkyl, $C_{11}$–$C_{18}$ alkenyl, and mixtures thereof; $R^2$, $R^3$, and $R^4$ are each preferably $C_1$–$C_4$ alkyl, more preferably each $R^2$, $R^3$, and $R^4$ are methyl.

The formulator may similarly choose $R^1$ to be a $R^5—Q—(CH_2)_m—$ moiety wherein $R^5$ is an alkyl or alkenyl moiety having from 1 to 22 carbon atoms, preferably the alkyl or alkenyl moiety when taken together with the Q unit is an acyl unit derived preferably derived from a source of triglyceride selected from the group consisting of tallow, partially hydrogenated tallow, lard, partially hydrogenated lard, vegetable oils and/or partially hydrogenated vegetable oils, such as, canola oil, safflower oil, peanut oil, sunflower oil, corn oil, soybean oil, tall oil, rice bran oil, etc. and mixtures thereof.

An example of a fabric softener cationic booster comprising a $R^5—Q—(CH_2)_m—$ moiety has the formula:

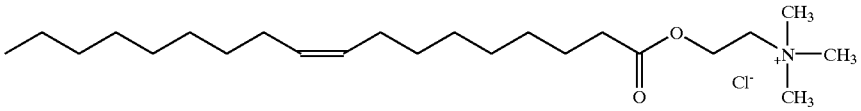

wherein $R^5—Q—$ is an oleoyl units and m is equal to 2.

X is a softener compatible anion, preferably the anion of a strong acid, for example, chloride, bromide, methylsulfate, ethylsulfate, sulfate, nitrate and mixtures thereof, more preferably chloride and methyl sulfate.

ii) Polyvinyl Amines

A preferred embodiment of the present invention contains at least about 0.2%, preferably from about 0.2% to about 5%, more preferably from about 0.2% to about 2% by weight, of one or more polyvinyl amines having the formula

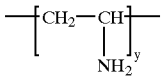

wherein y is from about 3 to about 10,000, preferably from about 10 to about 5,000, more preferably from about 20 to about 500. Polyvinyl amines suitable for use in the present invention are available from BASF.

Optionally, one or more of the polyvinyl amine backbone $—NH_2$ unit hydrogens can be substituted by an alkyleneoxy unit having the formula:

$—(R^1O)_xR^2$ wherein $R^1$ is $C_2$–$C_4$ alkylene, $R^2$ is hydrogen, $C_1$–$C_4$ alkyl, and mixtures thereof; x is from 1 to 50. In one embodiment or the present invention the polyvinyl amine is reacted first with a substrate which places a 2-propyleneoxy unit directly on the nitrogen followed by reaction of one or more moles of ethylene oxide to form a unit having the general formula:

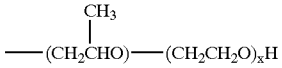

wherein x has the value of from 1 to about 50. Substitutions such as the above are represented by the abbreviated formula $PO—EO_x—$. However, more than one propyleneoxy unit can be incorporated into the alkyleneoxy substituent.

Polyvinyl amines are especially preferred for use as cationic charge booster in liquid fabric softening compositions since the greater number of amine moieties per unit weight provides substantial charge density. In addition, the cationic charge is generated in situ and the level of cationic charge can be adjusted by the formulator.

iii) Poly-Quaternary Ammonium Compounds

A preferred composition of the present invention comprises at least about 0.2%, preferably from about 0.2% to about 10%, more preferably from about 0.2% to about 5% by weight, of a cationic charge booster having the formula:

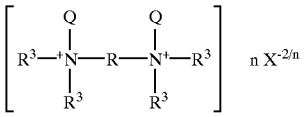

wherein R is $C_2$–$C_{12}$ alkylene, preferably $C_2$–$C_8$ alkylene, more preferably hexamethylene; each $R^3$ is independently $R^1$, an acyl comprising unit having the formula:

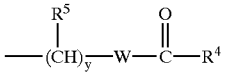

wherein $R^4$ is $C_6$–$C_{22}$ linear or branched, substituted or unsubstituted alkyl, $C_6$–$C_{22}$ linear or branched, substituted or unsubstituted alkenyl, or mixtures thereof; and mixtures thereof; each $R^5$ is independently hydrogen, —OH, —$NH_2$, —$(CH_2)_zWC(O)R^4$, and mixtures thereof; Q is a quaternizing unit selected from the group consisting of $C_1$–$C_{12}$ alkyl, benzyl, and mixtures thereof; W is —O—, —NH—, and mixtures thereof; X is a water soluble cation; the index n is 1 or 2; y is from 2 to 6; z is from 0 to 4; y+z is less than 7.

An example of a fabric softener cationic booster comprising a —$(CH_2)_zWC(O)R^4$ moiety has the formula:

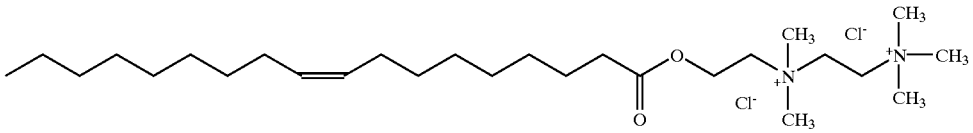

wherein $R^3$ is methyl or —$(CH_2)_zWC(O)R^4$. Q is methyl, W is oxygen, the index z is equal to 2, such that —$WC(O)R^4$ is an oleoyl unit.

Cationic Nitrogen Compounds

The fabric enhancement compositions of the present invention may optionally comprise from about 0.5%, preferably from about 1% to about 10%, preferably to about 5% by weight, of one or more cationic nitrogen containing compound, preferably a cationic compound having the formula:

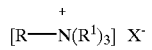

wherein R is $C_{10}$–$C_{18}$ alkyl, each $R^1$ is independently $C_1$–$C_4$ alkyl, X is a water soluble anion; preferably R is $C_{12}$–$C_{14}$, preferably $R^1$ is methyl. Preferred X is halogen, more preferably chlorine. Examples of cationic nitrogen compounds suitable for use in the fabric care compositions of the present invention are Non-limiting examples of preferred cationic nitrogen compounds are N,N-dimethyl-(2-hydroxyethyl)-N-dodecyl ammonium bromide, N,N-dimethyl-(2-hydroxyethyl)-N-tetradecyl ammonium bromide. Suitable cationic nitrogen compounds are available ex Akzo under the tradenames Ethomeen T/15®, Secomine TA15®, and Ethoduomeen T/20®.

Dispersibility Aids

Relatively concentrated compositions containing both saturated and unsaturated diester quaternary ammonium compounds can be prepared that are stable without the addition of concentration aids. However, the compositions of the present invention may require organic and/or inorganic concentration aids to go to even higher concentrations and/or to meet higher stability standards depending on the other ingredients. These concentration aids which typically can be viscosity modifiers may be needed, or preferred, for ensuring stability under extreme conditions when particular softener active levels are used. The surfactant concentration aids are typically selected from the group consisting of (1) single long chain alkyl cationic surfactants; (2) nonionic surfactants; (3) amine oxides; (4) fatty acids; and (5) mixtures thereof. These aids are described in P&G Copending application Ser. No. 08/461,207, filed Jun. 5, 1995, Wahl et al., specifically on page 14, line 12 to page 20, line 12 which is herein incorporated by reference.

When said dispersibility aids are present, the total level is from 2% to 25%, preferably from 3% to 17%, more preferably from 4% to 15%, and even more preferably from 5% to 13% by weight of the composition. These materials can either be added as part of the active softener raw material, e.g., the mono-long chain alkyl cationic surfactant and/or the fatty acid which are reactants used to form the fabric softener active as discussed hereinbefore, or added as a separate component. The total level of dispersibility aid includes any amount that may be present as part of the softener active.

Soil Release Agents

Particular to the embodiments of the rinse-added fabric softeners according to the present invention, certain soil release agents provide not only the below described soil release properties but are added for their suitability in maintaining proper viscosity, especially in the dispersed phase, non-isotropic compositions.

Any polymeric soil release agent known to those skilled in the art can optionally be employed in the compositions and processes of this invention. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of the rinsing cycle and, thus, serve as an anchor for the hydrophilic segments. This can enable stains occurring subsequent to treatment with the soil release agent to be more easily cleaned in later washing procedures.

If utilized, soil release agents will generally comprise from about 0.01% to about 10.0%, by weight, of the detergent compositions herein, typically from about 0.1% to about 5%, preferably from about 0.2% to about 3.0%.

The following, all included herein by reference, describe soil release polymers suitable for us in the present invention. U.S. Pat. No. 5,728,671 Rohrbaugh et al., issued Mar. 17, 1998; U.S. Pat. No. 5,691,298 Gosselink et al., issued Nov. 25, 1997; U.S. Pat. No. 5,599,782 Pan et al., issued Feb. 4, 1997; U.S. Pat. No. 5,415,807 Gosselink et al., issued May 16, 1995; U.S. Pat. No. 5,182,043 Morrall et al., issued Jan. 26, 1993; U.S. Pat. No. 4,956,447 Gosselink et al., issued Sep. 11, 1990; U.S. Pat. No. 4,976,879 Maldonado et al. issued Dec. 11, 1990; U.S. Pat. No. 4,968,451 Scheibel et al., issued Nov. 6, 1990; U.S. Pat. No. 4,925,577 Borcher, Sr. et al., issued May 15, 1990; U.S. Pat. No. 4,861,512 Gosselink, issued Aug. 29, 1989; U.S. Pat. No. 4,877,896

Maldonado et al., issued Oct. 31, 1989; U.S. Pat. No. 4,721,580 Gosselink issued Jan. 26, 1988; U.S. Pat. No. 4,702,857 Gosselink, issued Oct. 27, 1987; U.S. Pat. No. 4,711,730 Gosselink et al., issued Dec. 8, 1987; U.S. Pat. No. 4,000,093 Nicol et al., issued Dec. 28, 1976; U.S. Pat. No. 3,959,230 Hayes, issued May 25, 1976; U.S. Pat. No. 3,893,929 Basadur, issued Jul. 8, 1975; and European Patent Application 0 219 048, published Apr. 22, 1987 by Kud et al.

Further suitable soil release agents are described in U.S. Pat. No. 4,201,824 Voilland et al.; U.S. Pat. No. 4,240,918 Lagasse et al.: U.S. Pat. No. 4,525,524 Tung et al.; U.S. Pat. No. 4,579,681 Ruppert et al.; U.S. Pat. Nos. 4,220,918; 4,787,989; EP 279,134 A, 1988 to Rhone-Poulenc Chemie; EP 457,205 A to BASF (1991); and DE 2,335,044 to Unilever N. V., 1974; all incorporated herein by reference.

Cationic Nitrogen Compounds

The fabric enhancement compositions of the present invention may optionally comprise from about 0.5%, preferably from about 1% to about 10%, preferably to about 5% by weight, of one or more cationic nitrogen containing compound, preferably a cationic compound having the formula:

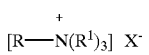

wherein R is $C_{10}$–$C_{18}$ alkyl, each $R^1$ is independently $C_1$–$C_4$ alkyl, X is a water soluble anion; preferably R is $C_{12}$–$C_{14}$, preferably $R^1$ is methyl. Preferred X is halogen, more preferably chlorine. Examples of cationic nitrogen compounds suitable for use in the fabric care compositions of the present invention are Non-limiting examples of preferred cationic nitrogen compounds are N,N-dimethyl-(2-hydroxyethyl)-N-dodecyl ammonium bromide, N,N-dimethyl-(2-hydroxyethyl)-N-tetradecyl ammonium bromide. Suitable cationic nitrogen compounds are available ex Akzo under the tradenames Ethomeen T/15®, Secomine TA15®, and Ethoduomeen T/20®.

The following compositions illustrate the present invention.

TABLE I

| | Weight % | | | |
|---|---|---|---|---|
| Ingredients | 1 | 2 | 3 | 4 |
| DEQA[1] | 26.0 | 25.7 | — | 30.0 |
| MAQ[2] | — | — | 26.0 | — |
| Polypropyleneimine[3] | 2.0 | — | — | — |
| Polypropyleneimine[4] | — | 1.0 | — | — |
| Polypropyleneimine[5] | — | — | 2.0 | 2.4 |
| Ethanol | 2.2 | 2.4 | 2.2 | 2.6 |
| Hexylene glycol | 2.6 | 2.3 | 2.6 | 2.6 |
| 1,2-Hexanediol | 17.0 | — | 17.0 | — |
| TMPD[6] | — | 11.9 | — | 12.0 |
| CHDM[7] | — | 5.0 | — | 48.1 |

TABLE I-continued

| | Weight % | | | |
|---|---|---|---|---|
| Ingredients | 1 | 2 | 3 | 4 |
| Water | 52.5 | 53.6 | 52.5 | 48.1 |
| Minors[8] | balance | balance | balance | balance |

[1]N,N-di(canoyloxyethyl)-N-2-hydroxyethyl-N-methyl ammonium methyl sulfate available from Witco.
[2]Monocanolyl trimethyl ammonium chloride, available as Adogen 417 ® from Witco.
[3]N,N'-(3-aminopropyl)ethylenediamine.
[4]N,N'-(3-aminopropyl)butylenediamine.
[5]Tripropylenetetraamine.
[6]Trimethyl pentanediol available from Eastman Chemical.
[7]1,4-cyclohexane dimethanol available from Eastman Chemical.
[8]Minors can include perfume, dye, acid, preservatives, etc.

TABLE II

| | weight % | | | | |
|---|---|---|---|---|---|
| Ingredients | 5 | 6 | 7 | 8 | 9 |
| Softener Active[1] | 28.0 | 30.0 | 30.0 | 30.0 | 30.0 |
| Polypropyleneimine[2] | 2.0 | 2.3 | 2.0 | 2.0 | 3.0 |
| Ethanol | 2.4 | 2.3 | 2.6 | 2.6 | 2.6 |
| Hexyleneglycol | 2.3 | 2.7 | 2.3 | 2.3 | 2.3 |
| 2,2,4-Trimethyl-1,3-pentanediol | 4.0 | — | 5.0 | 9.0 | 9.0 |
| 2-Ethyl-1,3-hexandiol | 4.0 | — | — | — | — |
| Polyoxyalkylene alkylamide[3] | 1.5 | 1.5 | 1.5 | 1.5 | — |
| Polyoxyalkylene alkylamide[4] | — | — | — | — | 1.5 |
| $CaCl_2$ | 0.05 | 0.5 | 0.125 | 0.125 | 0.125 |
| Perfume | 2.5 | 1.0 | 2.5 | 2.5 | 2.5 |
| Demineralized water | balance | balance | balance | balance | balance |

[1]N,N-di-(canolyl-oxy-ethyl)-N-methyl-N-(2-hydroxyethyl) ammonium methyl sulfate.
[2]Tripropylenetetraamine.
[3]PEG-6 cocamide, (Rewopal C6 ex Witco Chemical).
[4]PEG-5 lauramide (Amidox L-5, ex Stepan Chemical).

TABLE III

| | weight % | | | | |
|---|---|---|---|---|---|
| Ingredients | 10 | 11 | 12 | 13 | 14 |
| Softener Active[1] | 30.0 | 30.0 | 35.0 | 23.4 | 36.0 |
| Polyamine[2] | 2.0 | 2.3 | 2.0 | 2.0 | 3.0 |
| Ethanol | 2.6 | 3.4 | 2.5 | 2.0 | 3.1 |
| Hexyleneglycol | 2.3 | 2.3 | 2.5 | — | 6.2 |
| 2,2,4-Trimethyl-1,3-pentanediol | 9.0 | 9.0 | 4.0 | — | — |
| 2-Ethyl-1,3-hexandiol | — | — | 4.0 | — | — |
| Polyoxyalkylene alkylamide[3] | — | 1.5 | 3.0 | 2.1 | 1.8 |
| Polyoxyalkylene alkylamide[4] | 1.5 | | — | — | — |
| Monocanola trimethylammonium chloride[5] | — | 1.5 | — | — | — |
| $CaCl_2$ | 0.125 | 0.125 | 0.125 | 0.33 | 0.125 |
| Perfume | 2.5 | 2.5 | 2.5 | 2.1 | 1.2 |
| Demineralized water | balance | balance | balance | balance | balance |

[1]N,N-di-(canolyl-oxy-ethyl)-N-methyl-N-(2-hydroxyethyl) ammonium methyl sulfate.
[2]N,N'-bis(3-aminopropyl)-1,4-piperazine.
[3]PEG-6 cocamide, (Rewopal C6 ex Witco Chemical).
[4]PEG-7 oleamide (Ethomid 0/17, ex Akzo Chemical).
[5]Adogen 417, ex Witco Chemical.

TABLE IV

| Ingredients | weight % | | | | | |
|---|---|---|---|---|---|---|
| | 15 | 16 | 17 | 18 | 19 | 20 |
| Softener active[1] | 24.0 | — | — | — | — | 25.0 |
| Softener active[2] | — | — | 19.2 | — | — | — |
| Softener active[3] | — | — | — | — | 18.0 | — |
| Softener active[4] | — | 11.0 | — | 4.0 | — | — |
| Softener active[5] | — | 13.5 | — | — | — | — |
| Softener active[6] | — | | — | 3.4 | — | — |
| Ethanol | 4.0 | 5.0 | — | 1.0 | — | 4.0 |
| Isopropanol | — | — | 3.0 | — | 6.0 | — |
| Color care agent[7] | 2.5 | 3.0 | 3.0 | 3.0 | 4.0 | — |
| Calcium chloride | 2.0 | 0.5 | 0.2 | 0.05 | 0.5 | 0.6 |
| Hydrochloric acid | 0.75 | — | 0.06 | 0.2 | 0.02 | 0.05 |
| Soil release agent[8] | 0.5 | — | 0.2 | — | — | 0.5 |
| Polyamine[9] | 1.0 | 2.5 | — | — | — | — |
| Polyamine[10] | — | — | 1.0 | — | — | — |
| Polyamine[11] | — | — | — | — | 1.0 | — |
| Polyamine[12] | — | — | — | — | — | 1.0 |
| Polyamine[13] | — | — | — | 2.0 | — | — |
| Silicone anti-foam | 0.01 | — | 0.01 | 0.01 | — | 0.01 |
| Miscellaneous | 1.4 | 1.0 | 0.7 | 0.4 | 1.0 | 1.3 |
| Water | balance | balance | balance | balance | balance | balance |

[1]N,N-di(tallowyl-oxy-ethyl)-N,N-dimethyl ammonium chloride (tallowyl having an I.V. of 50).
[2]N,N-di(tallowyl-oxy-ethyl)-N,N-dimethyl ammonium chloride (tallowyl having an I.V. of 18).
[3]1,2-Ditallowyloxy-3-N,N,N-trimethylammoniopropane chloride.
[4]Ditallow dimethyl ammonium chloride.
[5]Methyl bis(tallow amidoethyl)-2-hydroxyethyl ammonium methyl sulfate.
[6]1-Tallowamidoethyl-2-imidazoline.
[7]N,N,N',N'-terakis(2-hydroxypropyl)ethylenediamine.
[8]Dimethyl terephthalate, 1,2-propylene glycol, methyl capped PEG polymer.
[9]N,N'-bis(3-aminopropyl)-1,3-propylenediamine.
[10]N,N'-bis(3-aminopropyl)-1,3-propylenediamine wherein each N–H unit is replaced by a 1,2-propyleneoxy unit.
[11]Pentrol ® available ex BASF.
[12]Bis(hexamethylene)triamine wherein each N–H unit is replaced by a methyl unit.
[13]N,N'-bis(2-hydroxybutyl)-N,N'-bis[3-N,N-bis(2-hydroxybutyl) aminopropyl]-1,3-propylenediamine, which is N,N'-bis(3-aminopropyl)-1,3-propylenediamine wherein each hydrogen of the backbone is replaced by a 2-hydroxybutyl moiety.

The following are examples of compositions which prevent the fading of dye from fabric, especially cotton fabric.

TABLE V

| Ingredients | weight % | | | | |
|---|---|---|---|---|---|
| | 21 | 22 | 23 | 24 | 25 |
| Softener Active[1] | 10.00 | 15.00 | — | 28.00 | — |
| Cationic dye fixative[2] | — | 3.00 | — | — | — |
| Hydrophobic dispersant[3] | 25.00 | 10.00 | 15.00 | — | — |
| Hydrophobic dispersant[4] | — | — | — | 10.00 | — |
| Hydrophobic dispersant[5] | — | — | — | — | 50.00 |
| Anti-scaling agent[6] | 1.00 | — | — | 1.00 | — |
| Anti-scaling agent[7] | — | — | — | — | 2.00 |
| Enzyme[8] | — | 0.50 | — | — | — |
| Polyamine[9] | 10.00 | 20.00 | 5.00 | | — |
| Polyamine[10] | — | — | — | 15.00 | — |
| Polyamine[11] | — | — | — | — | 10.00 |
| Perfume | 0.15 | 0.40 | 0.10 | 0.15 | 0.15 |
| Minors | balance | balance | balance | balance | balance |

[1]N,N-di-(canolyl-oxy-ethyl)-N-methyl-N-(2-hydroxyethyl) ammonium methyl sulfate.
[2]Selected from REWIN SRF, REWIN SRF-O and REWIN DWR ex CHT-Beitlich GMBH.
[3]Polyalkyleneimine having a molecular weight of 1800 and an average ethoxylation per backbone nitrogen of approximately 4.
[4]Polyalkyleneimine having a molecular weight of 1800 and an average ethoxylation per backbone nitrogen of approximately 1.

TABLE V-continued

| Ingredients | weight % | | | | |
|---|---|---|---|---|---|
| | 21 | 22 | 23 | 24 | 25 |

[5]Polyalkyleneimine having a molecular weight of 1800 and an average ethoxylation per backbone nitrogen of approximately 7.
[6]Hydroxyethanediphosphonate (HEDP).
[7]BAYHIBIT AM ex Baeyer.
[8]Suitable enzymes include cellulase, lipase, protease, peroxidase, and mixtures thereof.
[9]N,N'-bis(propyleneamino)-1,4-piperazine.
[10]5-N-methyl dipropylenetriamine.
[11]N,N'-bis(propyleneamino)-1,4-piperazine P1.

The following examples describe fabric enhancement compositions of the present invention which can be applied to fabric to achieve color fidelity and other fabric benefits.

TABLE VI

| Ingredients | Weight % | | | |
|---|---|---|---|---|
| | 26 | 27 | 28 | 29 |
| Polyamine[1] | 50.00 | — | — | — |
| Polyamine[2] | — | 36.00 | — | — |
| Polyamine[3] | — | — | 50.00 | — |
| Polyamine[4] | — | — | — | 42.00 |
| Water | balance | balance | balance | balance |

[1]N,N'-bis(3-aminopropyl)-1,3-propylamine.
[2]Hexapropyleneoxy N,N'-bis(3-aminopropyl)-1,3-propylamine (TPTA having each nitrogen fully substituted with a propyleneoxy unit).
[3]N,N'-bis(3-aminopropyl)-1,4-piperazine.
[4]Tetraethyleneoxy N,N'-bis(3-aminopropyl)-1,4-piperazine (BNPP having each terminal nitrogen fully substituted with an ethyleneoxy unit).

The following are non-limiting examples of fabric care compositions according to the present invention.

TABLE VII

| Ingredients | Weight % | | | |
|---|---|---|---|---|
| | 30 | 31 | 32 | 33 |
| Polymer[1] | — | 7.5 | 3.5 | 3.5 |
| Dye fixative[2] | 2.5 | 5.0 | 2.4 | 2.4 |
| Polyamine[3] | — | 5.0 | 10.0 | — |
| Polyamine[4] | — | — | — | 10.0 |
| Bayhibit[5] | 1.0 | 1.0 | 1.0 | 1.0 |
| Water | balance | balance | balance | balance |

[1]Polyvinylpyrrolidone K85 available ex BASF as Luviskol ® K85.
[2]Dye fixing agent ex Clariant under the tradename Cartafix CB ®.
[3]1,1-N-dimethyl-9,9-N"-dimethyl dipropylenetriamine.
[4]1,1-N-dimethyl-5-N'-methyl-9,9-N"-dimethyl dipropylenetriamine.
[5]2-Phosphonobutane-1,2,4-tricarboxylic acid ex Bayer.

TABLE VIII

| Ingredients | Weight % | | | |
|---|---|---|---|---|
| | 34 | 35 | 36 | 37 |
| Polymer[1] | 3.5 | 3.5 | 2.0 | — |
| Dye fixative[2] | 2.4 | 2.4 | 1.0 | 2.5 |
| Polyamine[3] | 15.0 | 17.0 | 5.0 | 7.0 |
| Fabric softener[4] | — | — | 10.0 | — |

TABLE VIII-continued

| Ingredients | Weight % | | | |
|---|---|---|---|---|
| | 34 | 35 | 36 | 37 |
| Bayhibit[5] | 1.0 | 1.0 | 0.2 | 1.0 |
| Water | balance | balance | balance | balance |

[1]Polyvinylpyrrolidone K85 available ex BASF as Luviskol ® K85.

[2]Dye fixing agent ex Clariant under the tradename Cartafix CB ®.

[3]N,N'-bis(3-aminopropyl)-1,4-piperazine.

[4]Di (tallowyloxyethyl)dimethyl ammonium chloride.

[5]2-Phosphonobutane-1,2,4-tricarboxylic acid ex Bayer.

TABLE IX

| Ingredients | Weight % | | | |
|---|---|---|---|---|
| | 38 | 39 | 40 | 41 |
| Polymer[1] | 4.5 | 4.5 | 3.5 | 3.5 |
| Dye fixative[2] | 2.4 | 2.4 | 2.4 | 2.4 |
| Polyamine[3] | 7.0 | 8.0 | — | — |
| Polyamine[4] | — | — | 15.0 | — |
| Polyamine[5] | — | — | — | 15.0 |
| Bayhibit[6] | 1.0 | 1.0 | 1.0 | 1.0 |
| Water | balance | balance | balance | balance |

[1]Polyvinylpyrrolidone K85 available ex BASF as Luviskol ® K85.
[2]Dye fixing agent ex Clariant under the tradename Cartafix CB ®.
[3]1,1-N-dimethyl-9,9-N"-dimethyl dipropylenetriamine.
[4]1,1-N-dimethyl-5-N'-methyl-9,9-N"-dimethyl dipropylenetriamine.
[5]N,N'-bis(3-aminopropyl)-1,4-piperazine.
[6]2-Phosphonobutane-1,2,4-tricarboxylic acid ex Bayer.

TABLE X

| Ingredients | Weight % | | | |
|---|---|---|---|---|
| | 42 | 43 | 44 | 45 |
| Polymer[1] | 4.5 | 4.5 | 3.5 | 3.5 |
| Dye fixative[2] | 2.4 | 2.4 | 2.4 | 2.0 |
| Polyamine[3] | — | — | 17.0 | 25.0 |
| Polyamine[4] | 20.0 | 25.0 | — | — |
| Bayhibit[5] | 1.0 | 1.0 | 1.0 | 0.2 |
| Water | balance | balance | balance | balance |

[1]Polyvinylpyrrolidone K85 available ex BASF as Luviskol ® K85.
[2]Dye fixing agent ex Clariant under the tradename Cartafix CB ®.
[3]N,N'-bis(3-aminopropyl)-1,4-piperazine.
[4]1,1-N-dimethyl-5-N'-methyl-9,9-N"-dimethyl dipropylenetriamine.
[5]2-Phosphonobutane-1,2,4-tricarboxylic acid ex Bayer.

TABLE XI

| Ingredients | Weight % | | | |
|---|---|---|---|---|
| | 46 | 47 | 48 | 49 |
| DEQA[1] | 26.0 | 25.7 | — | 30.0 |
| MAQ[2] | — | — | 26.0 | — |
| Polypropyleneimine[3] | 2.0 | — | — | — |
| Polypropyleneimine[4] | — | 1.0 | — | — |
| Polypropyleneimine[5] | — | — | 2.0 | 2.4 |
| Ethanol | 2.2 | 2.4 | 2.2 | 2.6 |
| Hexylene glycol | 2.6 | 2.3 | 2.6 | 2.6 |
| 1,2-Hexanediol | 17.0 | — | 17.0 | — |
| TMPD[6] | — | 11.9 | — | 12.0 |
| CHDM[7] | — | 5.0 | — | 48.1 |

TABLE XI-continued

| Ingredients | Weight % | | | |
|---|---|---|---|---|
| | 46 | 47 | 48 | 49 |
| Water | 52.5 | 53.6 | 52.5 | 48.1 |
| Minors[8] | balance | balance | balance | balance |

[1]N,N-di(canoyloxyethyl)-N-2-hydroxyethyl-N-methyl ammonium methyl sulfate available from Witco.
[2]Monocanolyl trimethyl ammonium chloride, available as Adogen 417 ® from Witco.
[3]5-N-methyl dipropylenetriamine.
[4]1,1-N-dimethyl-5-N'-methyl-9,9-N"-dimethyl dipropylenetriamine.
[5]Tripropylenetetraamine.
[6]Trimethyl pentanediol available from Eastman Chemical.
[7]1,4-cyclohexane dimethanol available from Eastman Chemical.
[8]Minors can include perfume, dye, acid, preservatives, etc.

What is claimed is:

1. A rinse-added fabric care composition comprising:

a) from about 0.01% to about 50% by weight, of a polyamine, said polyamine selected from:

i) linear polyamines having the formula:

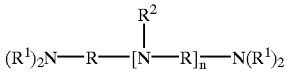

wherein each R is 1,3-propylene; $R^1$ is hydrogen, $C_1$–$C_{12}$ alkyl, alkyleneoxy having the formula:

$$—(R^3O)_m—R^4$$

$R^3$ is $C_2$–$C_6$ linear alkylene, $C_3$–$C_6$ branched alkylene, or mixtures thereof, $R^4$ is hydrogen, $C_1$–$C_6$ alkyl, or mixtures thereof, m is from 1 to 4; acyl having the formula:

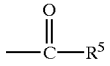

wherein $R^5$ is $C_1$–$C_{22}$ linear or branched alkyl, $C_3$–$C_{22}$ linear or branched alkenyl, or mixtures thereof; hydroxy alkyl having the formula:

$$—(CH_2)_y(CHOH)_zH$$

wherein y is from 1 to 5, z is from 1 to 3, provided y+z is less than or equal to 6; two $R^1$ units can be taken together to form a 5–7 member ring; and mixtures thereof; $R^2$ is hydrogen, $R^1$, $—RN(R^1)_2$, and mixtures thereof; n is from 1 to 6;

ii) cyclic polyamines having the formula:

$$R—L—R$$

wherein L is a linking unit, said linking unit comprising a ring having at least 2 nitrogen atoms; R is hydrogen, $—(CH_2)_kN(R^1)_2$, and mixtures thereof, wherein at least one cyclic polyamine R unit is a $—(CH_2)_kN(R^1)_2$ unit; $R^1$ is exclusively hydrogen; or a moiety selected from the group consisting of $C_1$–$C_{12}$ alkyl; alkyleneoxy having the formula:

$$—(R^3O)_m—R^4$$

$R^3$ is $C_2$–$C_6$ linear alkylene, $C_3$–$C_6$ branched alkylene, or mixtures thereof, $R^4$ is hydrogen, $C_1$–$C_6$ alkyl, or mixtures thereof, m is from 1 to 4; acyl having the formula:

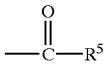

wherein $R^5$ is $C_1$–$C_{22}$ linear or branched alkyl, $C_3$–$C_{22}$ linear or branched alkenyl, or mixtures thereof; hydroxy alkyl having the formula:

$$—(CH_2)_y(CHOH)_zH$$

wherein y is from 1 to 5, z is from 1 to 3, provided y+z is less than or equal to 6; two $R^1$ units can be taken together to form a 5–7 member ring; k is from 3 to 12; and mixtures thereof;

iii) and mixtures thereof;

b) optionally less than about 15% by weight, of a principal solvent; and c) the balance carrier and adjunct ingredients.

2. A composition according to claim 1 wherein $R^1$ is exclusively hydrogen, or a moiety selected from the group consisting of $C_1$–$C_{12}$ alkyl, alkyleneoxy unit having the formula:

$$—(R^3O)_m—R^4$$

wherein $R^3$ is $C_2$–$C_6$ linear alkylene, $C_3$–$C_6$ linear alkylene, or mixtures thereof; $R^4$ is hydrogen; and mixtures thereof; m is 1.

3. A composition according to claim 1 wherein each $R^1$ is exclusively hydrogen, or a moiety selected from the group consisting of hydroxyethyl, 2-hydroxypropyl, and mixtures thereof.

4. A composition according to claim 1 wherein said polyamine is N,N'-bis(aminopropyl)-1,3-propylenediamine, N,N'-bis(hydroxyethyl)-N,N'-bis[3-N,N-bis(hydroxyethyl) aminopropyl]-1,3-propylenediamine, N,N'-bis(2-hydroxypropyl)-N,N'-bis[3-N,N-bis(2-hydroxypropyl) aminopropyl]-1,3-propylenediamine, N,N'-bis(2-hydroxybutyl)-N,N'-bis[3-N,N-bis(2-hydroxybutyl) aminopropyl]-1,3-propylenediamine, 5-N-methyl dipropylenetriamine, 1,1-N-dimethyl-5-N'-methyl-9,9-N"-dimethyl dipropylenetriamine, 1,1-N-dimethyl-9,9-N"-dimethyl dipropylenetriamine, and mixtures thereof.

5. A composition according to claim 1 wherein $R^1$ is exclusively hydrogen, or alkyleneoxy having the formula:

$$—(R^3O)_m—R^4$$

wherein $R^3$ is $C_2$–$C_6$ linear alkylene, $C_3$–$C_6$ linear alkylene, or mixtures thereof; $R^4$ is hydrogen, $C_1$–$C_4$ alkyl, or mixtures thereof; and mixtures thereof; m is 1 to 4.

6. A composition according to claim 1 wherein said polyamine is a cyclic polyamine wherein L is piperazine.

7. A composition according to claim 1 wherein R is $—(CH_2)_kN(R^1)_2$, k is from 3 to 6; $R^1$ is exclusively hydrogen, or alkyleneoxy having the formula:

$$—(R^3O)_m—R^4$$

$R^3$ is $C_2$–$C_6$ linear alkylene, $C_3$–$C_6$ branched alkylene, or mixtures thereof, $R^4$ is hydrogen, $C_1$–$C_6$ alkyl, or mixtures thereof, m is from 1 to 4; and mixtures thereof.

8. A composition according to claim 1 wherein said polyamine is N,N'-bis(aminopropyl)-1,4-piperazine, N,N'-bis(hydroxyethyl)-N,N'-bis[3-N,N-bis(hydroxyethyl) aminopropyl]-1,4-piperazine, N,N'-bis(2-hydroxypropyl)-N,N'-bis[3-N,N-bis(2-hydroxypropyl)aminopropyl]-1,4-piperazine, and mixtures thereof.

9. A composition according to claim 1 wherein said polyamine is N,N'-bis(3-aminopropyl)-1,3-propylenediamine having the formula:

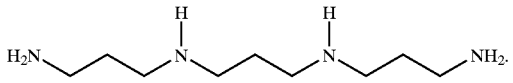

10. A composition according to claim 1 wherein said polyamine is a cyclic polyamine wherein L is 1,4-piperazine, R is 3-aminopropylene, each $R^1$ is exclusively hydrogen or 2-hydroxypropyl.

11. A composition according to claim 10 wherein said polyamine is N,N'-bis-(3-aminopropyl)-1,4-piperazine having the formula:

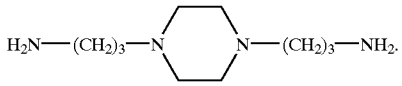

12. A composition according to claim 1 wherein said polyamine is 1,1,5,9,9-N-pentamethyl dipropylenetriamine having the formula:

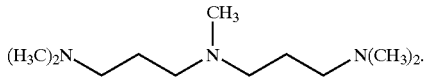

13. A composition according to claim 1 wherein said polyamine is 1,1,9,9-N-tetramethyl dipropylenetriamine having the formula:

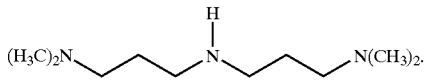

14. A composition according to claim 1 wherein said composition further comprises from about 1% to about 80% by weight, of a fabric softening active, said fabric softener active comprises a quaternary ammonium compound having the formula:

$$\left[(R)_{\overline{4-m}}\overset{+}{N}—\left[(CH_2)_{\overline{n}}—Q—R^1\right]_m\right] X^-,$$

an amine having the formula:

$$(R)_{\overline{3-m}}N—\left[(CH_2)_{\overline{n}}—Q—R^1\right]_m,$$

and mixtures thereof; wherein each R is independently $C_1$–$C_6$ alkyl, $C_1$–$C_6$ hydroxyalkyl, benzyl, and mixtures thereof; $R^1$ is $C_1$–$C_{22}$ alkyl, $C_3$–$C_{22}$ alkenyl, and mixtures thereof; Q is a carbonyl moiety having the formula:

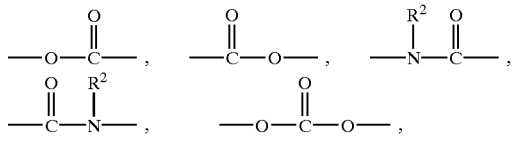

-continued

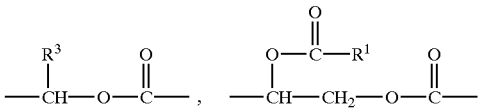

$R^2$ is hydrogen, $C_1$–$C_4$ alkyl, $C_1$–$C_4$ hydroxyalkyl, and mixtures thereof; $R^3$ is hydrogen, $C_1$–$C_4$ alkyl, and mixtures thereof; X is a softener compatible anion; m is from 1 to 3; n is from 1 to 4.

15. A composition according to claim 14 wherein said fabric softening active comprises an acyl moiety which is derived from a source of triglyceride selected from the group consisting of tallow, hard tallow, lard, canola oil, partially hydrogenated canola oil, safflower oil, partially hydrogenated safflower oil, peanut oil, partially hydrogenated peanut oil, sunflower oil, partially hydrogenated sunflower oil, corn oil, partially hydrogenated corn oil, soybean oil, partially hydrogenated soybean oil, tall oil, partially hydrogenated tall oil, rice bran oil, partially hydrogenated rice bran oil, synthetic triglyceride feedstocks, and mixtures thereof.

16. A composition according to claim 1 further comprising a principal solvent wherein said principal solvent has a C log P of from about 0.15 to about 1.

17. A composition according to claim 16 wherein said principal solvent is selected from the group consisting of mono-alcohols, $C_6$ diols, $C_7$ diols, $C_8$ diols, derivatives of butanediol, alkyl glyceryl ethers, di(hydroxy alkyl) ethers, aryl glyceryl ethers, the derivatives of alicyclic diols, derivatives of alkoxylated $C_3$–$C_7$ diols, aryl diols, and mixtures thereof.

18. A composition according to claim 17 comprising 2,2,4-trimethyl-1,3-pentandiol, 1,2-hexandiol, 2-ethyl-1,3-hexanediol, phenoxyethanol, butyl carbitol, and mixtures thereof.

19. A composition according to claim 1 further comprising adjunct ingredients selected from the group consisting of electrolytes, stabilizers, low molecular weight water soluble solvents, chelating agents, cationic charge boosters, dispersibility aids, soil release agents, nonionic fabric softening agents, concentration aid, perfume, preservatives, colorants, optical brighteners, opacifiers, fabric care agents, anti-shrinkage agents, anti-wrinkle agents, fabric crisping agents, spotting agents, germicides, fungicides, anti-corrosion agents, antifoam agents, and mixtures thereof.

20. A rinse-added fabric softener composition comprising:

a) from about 0.01% to about 50% by weight, of a linear polyamine having the formula:

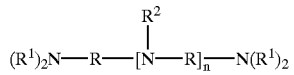

wherein each R is 1,3-propylene; $R^1$ is hydrogen, $C_1$–$C_{12}$ alkyl, alkyleneoxy having the formula:

$$—(R^3O)_m—R^4$$

$R^3$ is $C_2$–$C_6$ linear alkylene, $C_3$–$C_6$ branched alkylene, or mixtures thereof, $R^4$ is hydrogen, $C_1$–$C_6$ alkyl, or mixtures thereof, m is from 1 to 4; acyl having the formula:

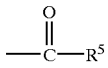

wherein $R^5$ is $C_1$–$C_{22}$ linear or branched alkyl, $C_3$–$C_{22}$ linear or branched alkenyl, or mixtures thereof; hydroxy alkyl having the formula:

$$—(CH_2)_y(CHOH)_zH$$

wherein y is from 1 to 5, z is from 1 to 3, provided y+z is less than or equal to 6; two $R^1$ units can be taken together to form a 5–7 member ring; and mixtures thereof; $R^2$ is hydrogen, $R^1$, $—RN(R^1)_2$, and mixtures thereof; n is from 1 to 6;

b) from about 1% to about 80% by weight, of a fabric softener active, said fabric softener active is selected from the group consisting of N,N-di(tallowyl-oxy-ethyl)-N,N-dimethyl ammonium chloride; N,N-di (canolyl-oxy-ethyl)-N,N-dimethyl ammonium chloride; N,N-di(tallowyl-oxy-ethyl)-N-methyl, N-(2-hydroxyethyl) ammonium methyl sulfate; N,N-di (canolyl-oxy-ethyl)-N-methyl, N-(2-hydroxyethyl) ammonium methyl sulfate; and mixtures thereof; and c) the balance carriers and adjunct ingredients, said adjunct ingredients selected from the group consisting of electrolytes, stabilizers, low molecular weight water soluble solvents, chelating agents, cationic charge boosters, dispersibility aids, soil release agents, nonionic fabric softening agents, concentration aid, perfume, preservatives, colorants, optical brighteners, opacifiers, fabric care agents, anti-shrinkage agents, anti-wrinkle agents, fabric crisping agents, spotting agents, germicides, fungicides, anti-corrosion agents, antifoam agents, and mixtures thereof.

21. A composition according to claim 20 wherein said polyamine is N,N'-bis(aminopropyl)-1,3-propylenediamine, N,N'-bis(hydroxyethyl)-N,N'-bis[3-N,N-bis(hydroxyethyl) aminopropyl]-1,3-propylenediamine, N,N'-bis(2-hydroxypropyl)-N,N'-bis[3-N,N-bis(2-hydroxypropyl) aminopropyl]-1,3-propylenediamine, N,N'-bis(2-hydroxybutyl)-N,N'-bis[3-N,N-bis(2-hydroxybutyl) aminopropyl]-1,3-propylenediamine, 5-N-methyl dipropylenetriamine, 1,1-N-dimethyl-5-N'-methyl-9,9-N"-dimethyl dipropylenetriamine, 1,1-N-dimethyl-9,9-N"-dimethyl dipropylenetriamine, and mixtures thereof.

22. A rinse-added fabric softener composition comprising:

a) from about 0.01% to about 50% by weight, of a cyclic polyamine having the formula:

$$R—L—R$$

wherein L is a linking unit, said linking unit comprising a ring having at least 2 nitrogen atoms; R is hydrogen, $—(CH_2)_kN(R^1)_2$, and mixtures thereof, wherein at least one cyclic polyamine R unit is a $—(CH_2)_kN(R^1)_2$ unit; $R^1$ is exclusively hydrogen; or a moiety selected from the group consisting of $C_1$–$C_{12}$ alkyl; alkyleneoxy having the formula:

$$—(R^3O)_m—R^4$$

$R^3$ is $C_2$–$C_6$ linear alkylene, $C_3$–$C_6$ branched alkylene, or mixtures thereof, $R^4$ is hydrogen, $C_1$–$C_6$ alkyl, or mixtures thereof, m is from 1 to 4; acyl having the formula:

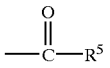

wherein $R^5$ is $C_1$–$C_{22}$ linear or branched alkyl, $C_3$–$C_{22}$ linear or branched alkenyl, or mixtures thereof; hydroxy alkyl having the formula:

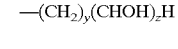

wherein y is from 1 to 5, z is from 1 to 3, provided y+z is less than or equal to 6; two $R^1$ units can be taken together to form a 5–7 member ring; k is from 3 to 12; and mixtures thereof;

b) from about 1% to about 80% by weight, of a fabric softener active, said fabric softener active is selected from the group consisting of N,N-di(tallowyl-oxy-ethyl)-N,N-dimethyl ammonium chloride; N,N-di (canolyl-oxy-ethyl)-N,N-dimethyl ammonium chloride; N,N-di(tallowyl-oxy-ethyl)-N-methyl, N-(2-hydroxyethyl) ammonium methyl sulfate; N,N-di (canolyl-oxy-ethyl)-N-methyl, N-(2-hydroxyethyl) ammonium methyl sulfate; and mixtures thereof; and c) the balance carriers and adjunct ingredients, said adjunct ingredients selected from the group consisting of electrolytes, stabilizers, low molecular weight water soluble solvents, chelating agents, cationic charge boosters, dispersibility aids, soil release agents, non-ionic fabric softening agents, concentration aid, perfume, preservatives, colorants, optical brighteners, opacifiers, fabric care agents, anti-shrinkage agents, anti-wrinkle agents, fabric crisping agents, spotting agents, germicides, fungicides, anti-corrosion agents, antifoam agents, and mixtures thereof.

23. A composition according to claim 22 wherein said cyclic polyamine is N,N'-bis(aminopropyl)-1,4-piperazine, N,N'-bis(hydroxyethyl)-N,N'-bis[3-N,N-bis(hydroxyethyl) aminopropyl]-1,4-piperazine, N,N'-bis(2-hydroxypropyl)-N,N'-bis[3-N,N-bis(2-hydroxypropyl)aminopropyl]-1,4-piperazine, and mixtures thereof.

24. A clear and/or translucent rinse-added fabric softening composition comprising:

a) at least an effective amount of a modified polyamine having the formula:

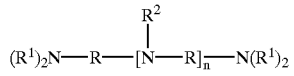

wherein R is 1,3-propylene; $R^1$ is an alkyleneoxy having the formula:

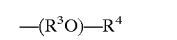

wherein $R^3$ is 1,2-propylene; $R^4$ is hydrogen; $R^2$ is hydrogen, —$RN(R^1)_2$, and mixtures thereof; n is 1 or 2; provided at least about 50% of said modified polyamines have n equal to 2 and one $R^2$ equal to hydrogen;

b) at least an effective amount of a fabric softener active, said fabric softener active is selected from the group consisting of N,N-di(tallowyl-oxy-ethyl)-N,N-dimethyl ammonium chloride; N,N-di(canolyl-oxy-ethyl)-N,N-dimethyl ammonium chloride; N,N-di (tallowyl-oxy-ethyl)-N-methyl, N-(2-hydroxyethyl) ammonium methyl sulfate; N,N-di(canolyl-oxy-ethyl)-N-methyl, N-(2-hydroxyethyl) ammonium methyl sulfate; and mixtures thereof;

c) less than about 15% by weight, of a principal solvent, said principal solvent having a C log P of from about 0.15 to about 1; and d) the balance carriers and adjunct ingredients.

25. A composition according to claim 24 wherein said polyamine is N,N'-bis(3-aminopropyl)-1,3-propylenediamine having the formula:

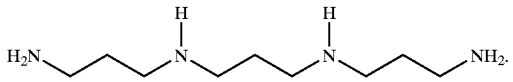

26. A composition according to claim 24 wherein said polyamine is 1,1,5,9,9-N-pentamethyl dipropylenetriamine having the formula:

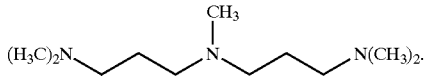

27. A composition according to claim 24 wherein said polyamine is 1,1,9,9-N-tetramethyl dipropylenetriamine having the formula:

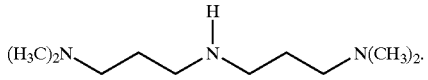

28. A composition according to claim 24 further comprising from about 0.5% to about 10% by weight, of a polyoxyalkylene alkylamide surface active agent having the formula:

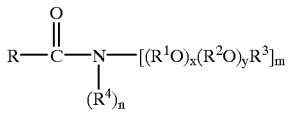

wherein R is $C_7$–$C_{21}$ linear alkyl, $C_7$–$C_{21}$ branched alkyl, $C_7$–$C_{21}$ linear alkenyl, $C_7$–$C_{21}$ branched alkenyl, and mixtures thereof; $R^1$ is ethylene; $R^2$ is $C_3$–$C_4$ linear alkyl, $C_3$–$C_4$ branched alkyl, and mixtures thereof; $R^3$ is hydrogen, $C_1$–$C_4$ linear alkyl, $C_3$–$C_4$ branched alkyl, and mixtures thereof; $R^4$ is hydrogen, $C_1$–$C_4$ linear alkyl, $C_3$–$C_4$ branched alkyl, and mixtures thereof; m is 1 or 2, n is 0 or 1, provided that when m is 1 and when m is 2 n is 0; x is from 0 to about 50; y is from 0 to about 10.

29. A rinse-added fabric care composition comprising:

a) from about 0.01% to about 20% by weight, a cyclic polyamine having the formula:

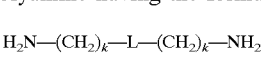

wherein L is a linking unit, said linking unit comprising a ring having at least 2 nitrogen atoms; each k is independently from 3 to 12;

b) from about 1% to about 80% by weight, of a fabric softening active;

c) from about 0.1% to about 10% by weight, of a dye fixative; and d) the balance carrier and adjunct ingredients.

30. A composition according to claim 29 wherein said polyamine has the formula:

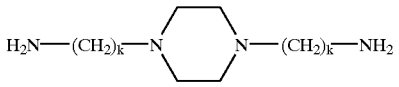

wherein each $R^1$ unit is hydrogen; each k is equal to 3.

31. A composition according to claim 30 wherein said fabric softener active is selected from the group consisting of N,N-di(tallowyl-oxy-ethyl)-N,N-dimethyl ammonium chloride; N,N-di(canolyl-oxy-ethyl)-N,N-dimethyl ammonium chloride; N,N-di(tallowyl-oxy-ethyl)-N-methyl, N-(2-hydroxyethyl) ammonium methyl sulfate; N,N-di(canolyl-oxy-ethyl)-N-methyl, N-(2-hydroxyethyl) ammonium methyl sulfate; and mixtures thereof.

32. A composition according to claim 29 wherein said adjunct ingredients are selected from the group consisting of nonionic fabric softening agents, concentration aid, soil release agent, perfume, preservatives, stabilizers, colorants, optical brighteners, opacifiers, fabric care agents, anti-shrinkage agents, anti-wrinkle agents, fabric crisping agents, spotting agents, germicides, fungicides, anti-corrosion agents, antifoam agents, and mixtures thereof.

33. A fabric care composition comprising:

a) from about 0.01% to about 20% by weight, of a fabric enhancement system comprising:

i) a linear polyamine having the formula:

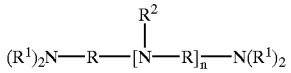

wherein R is 1,3-propylene; $R^1$ is an alkyleneoxy having the formula:

$$—(R^3O)—R^4$$

wherein $R^3$ is 1,2-propylene; $R^4$ is hydrogen; $R^2$ is hydrogen, $R^1$, $—RN(R^1)_2$, and mixtures thereof; n is 1 or 2; provided at least about 50% of said modified polyamines have n equal to 2 and one $R^2$ equal to hydrogen; and ii) a cyclic polyamine having the formula:

$$H_2N—(CH_2)_k—L—(CH_2)_k—NH_2$$

wherein L is a linking unit, said linking unit comprising a ring having at least 2 nitrogen atoms; each k is independently from 3 to 12; and b) the balance carrier and adjunct ingredients.

34. A rinse-added fabric care composition comprising:

a) from about 0.01% to about 50% by weight, of a polyamine, said polyamine selected from:

i) linear polyamines having the formula:

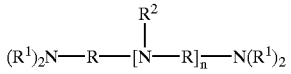

wherein each R is independently $C_2$–$C_6$ linear alkylene, $C_3$–$C_6$ branched alkylene, and mixtures thereof; $R^1$ is hydrogen, $C_1$–$C_{12}$ alkyl, alkyleneoxy having the formula:

$$—(R^3O)_m–R^4$$

$R^3$ is $C_2$–$C_6$ linear alkylene, $C_3$–$C_6$ branched alkylene, or mixtures thereof, $R^4$ is hydrogen, $C_1$–$C_6$ alkyl, or mixtures thereof, m is from 1 to 4; acyl having the formula:

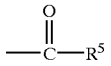

wherein $R^5$ is $C_1$–$C_{22}$ linear or branched alkyl, $C_3$–$C_{22}$ linear or branched alkenyl, or mixtures thereof; hydroxy alkyl having the formula:

$$—(CH_2)_y(CHOH)_zH$$

wherein y is from 1 to 5, z is from 1 to 3, provided y+z is less than or equal to 6; two $R^1$ units can be taken together to form a 5–7 member ring; and mixtures thereof; $R^2$ is hydrogen, $R^1$, $—RN(R^1)_2$, and mixtures thereof; n is from 1 to 6;

ii) cyclic polyamines having the formula:

$$R—L—R$$

wherein L is a linking unit, said linking unit comprising a ring having at least 2 nitrogen atoms; R is hydrogen, $—(CH_2)_kN(R^1)_2$, and mixtures thereof, wherein at least one cyclic polyamine R unit is a $—(CH_2)_kN(R^1)_2$ unit; $R^1$ is hydrogen; $C_1$–$C_{12}$ alkyl; alkyleneoxy having the formula:

$$—(R^3O)_m—R^4$$

$R^3$ is $C_2$–$C_6$ linear alkylene, $C_3$–$C_6$ branched alkylene, or mixtures thereof, $R^4$ is hydrogen, $C_1$–$C_6$ alkyl, or mixtures thereof, m is from 1 to 4; acyl having the formula:

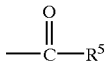

wherein $R^5$ is $C_1$–$C_{22}$ linear or branched alkyl, $C_3$–$C_{22}$ linear or branched alkenyl, or mixtures thereof; hydroxy alkyl having the formula:

$$—(CH_2)_y(CHOH)_zH$$

wherein y is from 1 to 5, z is from 1 to 3, provided y+z is less than or equal to 6; two $R^1$ units can be taken together to form a 5–7 member ring; k is from 3 to 12; and mixtures thereof;

iii) and mixtures thereof;

b) optionally from about 0.001% to about 90% by weight, of one or more dye fixing agents;

c) optionally from about 0.01% to about 50% by weight, of one or more cellulose reactive dye fixing agents;

d) optionally from about 0.01% to about 15% by weight, of a chlorine scavenger;

e) optionally about 0.005% to about 1% by weight, of one or more crystal growth inhibitors;

f) optionally from about 0.01% to about 20% by weight, of a fabric abrasion reducing polymer;

g) optionally from about 1% to about 12% by weight, of one or more liquid carriers;

h) optionally from about 0.001% to about 1% by weight, of an enzyme;

i) optionally from about 0.01% to about 8% by weight, of a polyolefin emulsion or suspension;

j) optionally from about 0.01% to about 0.2% by weight, of a stabilizer;

k) optionally from about 1% to about 80% by weight, of a fabric softening active;

i) optionally less than about 15% by weight, of a principal solvent;

(n) optionally from about 0.5% to about 10% by weight, of a cationic nitrogen compound; and o) the balance carrier and adjunct ingredients.

* * * * *